United States Patent [19]

Dojan

[11] 4,037,289

[45] July 26, 1977

[54] SCRUBBER SQUEEGEE APPARATUS

[75] Inventor: Harold D. Dojan, Cedar, Minn.

[73] Assignee: Tennant Company, Minneapolis, Minn.

[21] Appl. No.: 633,265

[22] Filed: Nov. 19, 1975

[51] Int. Cl.[2] ..... A47L 7/00; A47L 1/06

[52] U.S. Cl. ..... 15/320; 15/50 C; 15/340; 15/245

[58] Field of Search ..... 15/50 R, 50 C, 51, 245, 15/320, 340, 98, 359

[56] References Cited

U.S. PATENT DOCUMENTS

| | | | |
|---|---|---|---|
| 965,694 | 7/1910 | DeVallant | 15/359 |
| 1,828,139 | 10/1931 | Hawrylasz | 15/245 |
| 1,969,674 | 8/1934 | Anderson-Smedberg | 15/320 |
| 2,307,460 | 1/1943 | Greisen | 15/245 |
| 2,930,055 | 3/1960 | Fallen et al. | 15/320 |
| 3,065,490 | 11/1962 | Arones | 15/359 |
| 3,197,798 | 8/1965 | Brown et al. | 15/340 |
| 3,584,329 | 6/1971 | Cravits | 15/50 R |
| 3,879,789 | 4/1975 | Kasper | 15/320 |

*Primary Examiner*—Richard E. Aegerter
*Assistant Examiner*—John W. Shepperd
*Attorney, Agent, or Firm*—Dugger, Johnson & Westman

[57] ABSTRACT

Apparatus for maintaining surfaces that includes a powered mobile machine having a frame, a scrubbing tool, a liquid distributor ahead of the scrubbing tool, a clean solution tank for supplying liquid to the liquid distributor, a housing mounting the tool, a rear squeegee assembly and side squeegee assemblies, a dirty solution tank on the frame, and a vacuumized system for withdrawing liquid collected by the rear squeegee assembly and transferring it to the dirty solution tank. The rear squeegee assembly is preferably parabolic in plan view. Scissor type linkages are connected to the housing or other parts of the machine and each of the rear and side squeegee assemblies and are spring urged to urge the respective assembly downwardly with nearly constant pressure. Further, in each of the first and second embodiments of the rear squeegee assembly, parallel linkages mount the rear squeegee assembly for limited vertical movement relative the housing. Additionally, each of the squeegee assemblies, other than the one for the front squeegee of the third embodiment, includes quick release mechanism for removably retaining the squeegee on the respective squeegee frame, the quick release mechanism including an arcuately curved band for applying a squeegee clamping pressure. For the front squeegee of the third embodiment there is provided release mechanism that includes such a band and locking mechanism for releasably retaining the band in a clamping position that requires the turning of only a single bolt for releasing the clamping pressure applied by the band.

21 Claims, 18 Drawing Figures

SCRUBBER SQUEEGEE APPARATUS

BACKGROUND OF THE INVENTION

A surface maintenance machine that includes a squeegee assembly for engaging a surface being maintained. In the prior art it is old to provide a squeegee assembly on a surface cleaning machine and resiliently urge said squeegee assembly downwardly, for example, see U.S. Pat. Nos. 1,969,674; 3,065,490; 3,649,995; 3,702,488 and 3,833,961. However, in each of the above patents the downward force exerted on the squeegee assembly decreases as the assembly moves downwardly relative the housing (or other structure) on which it is mounted. Further, when a pair of leaf springs are used to mount a side squeegee assembly such as disclosed in some of the above patents, if the springs are set up to give proper squeegee down pressure, they have proved to be by in torsion which is caused buy the friction between the squeegee and the floor and the urging by random side movements of the scrubber head housing. Additionally, with such leaf springs when the front end of the squeegee hits an obstruction that does not move, sometimes the squeegee tears due to the resistance to movement of the squeegee over the obstruction, as the springs act as a parallel arm linkage.

Also, with conventional rear squeegee assemblies on scrubbing machines, it takes a relatively long time to replace worn squeegees. For example, on some prior art machines it takes about 2 to 3 hours to replace the front and rear squeegees of a rear squeegee assembly. This is an undesirable length of time, particularly when the machine is used for cleaning relatively rough surfaces and the squeegees have to be replaced relatively frequently.

In order to overcome problems such as the above, as well as others, this invention has been made.

SUMMARY OF THE INVENTION

The present invention relates to a surface cleaning machine having a rear squeegee assembly, or side squeegee assemblies, or both rear and side squeegee assemblies, wherein the squeegee assembly includes an elongated flexible squeegee, a squeegee frame having a squeegee backing surface, elongated band mechanism for abutting against the surface of the squeegee opposite the backing surface, and mechanism cooperating with the band mechanism and the squeegee frame for releasably retaining the band mechanism in a condition to clampingly hold the squeegee against the backing surface and still permit relatively easy replacement of the squeegee. Preferably, there is provided spring urged linkage mechanism that is connected between squeegee assembly and the part of the machine on which the assembly is mounted for exerting a nearly constant downward force on the squeegee assembly within the limits of vertical movement of the squeegee assembly during normal usage.

One of the objects of this invention is to provide new and novel quick release means for removably mounting a squeegee on a squeegee frame. In furtherance of the above object, it is another object of this invention to provide overcenter lock mechanism to releasably clamp a squeegee to a squeegee frame.

An additional object of this invention is to provide new and novel band clamping structure for removably retaining a squeegee on a squeegee frame. A further object of this invention is to provide new and novel tensioning means for retaining a squeegee on a squeegee frame.

An additional object of this invention is to provide a new and novel mounting mechanism for a side squeegee to, in an elevated side squeegee assembly condition, provide a novel squeegee configuration. In furtherance of the last mentioned object, it is another object of this invention to mount a side squeegee to in part be of a convoluted shape.

Another object of this invention is to provide a new and novel mounting of a rear squeegee to readily permit any one of the four elongated corner edges being used as the front lower edge during use. An additional object of this invention is to provide a new and novel mounting of squeegee in a curved configuration to eliminate any sharp changes in the curvature of the squeegee.

An additional object of this invention is to provide a new and novel mounting of a squeegee assembly on a surface cleaning machine for limited vertical movement relative thereto, and within the limited range of vertical movement, exert a nearly constant downward pressure on the assembly. Still another object of this invention is to provide a new and novel spring urged linkage for exerting a downward force on a squeegee assembly, and retaining the squeegee in wiping engagement with the surface at relatively high maintenance machine speeds even though the shape of the surface varies, and/or the height of the squeegee mounting structure varies relative the surface.

Another object of this invention is to provide a new and novel mounting of a squeegee member for obtaining more even wear along the lower edge thereof. Still another object of the invention is to provide new and novel mechanism that in compression clampingly retains a squeegee against a squeegee frame.

BRIEF DESCRIPTION OF THE DRAWINGS

Referring now to FIG. 1, there is diagrammatically illustrated a scrubbing machine, generally designated 10, on which the rear and side squeegee assemblies, generally designated 30 and 31, 32 respectively, of this invention are mounted. Since the scrubbing machine on which the squeegee assemblies of this invention may be used may be of a number of different forms, a typical machine will be briefly described. The machine 10 is a mobile scrubbing machine that includes a frame 12. A power source such as an engine or electric motor 11 is mounted on the frame 12 and connected by a suitable drive connection 19 to the surface engaging propulsion wheels 23, the tubular scrub brushes 13 and 14 that are rotated about parallel transverse axes, and the suction blower 15. Also, an operator's seat 20 and a steering control 21 that is connected by a conventional linkage to the steerable wheel or wheels is provided. A dirty scrubbing liquid collection tank 17 is mounted on the frame, and is connected by a line 16 to the suction blower for having a vacuum applied to the top of the tank 17. A liquid return line 18 is connected to the rear squeegee assembly 30 and to the tank 17 for withdrawing liquid from the rear squeegee assembly when a vacuum is applied to the collection tank, and discharging the liquid into the collection tank. Also mounted on the frame is a clean solution tank 22 having the valve line 24 for supplying a clean solution to the liquid distributor 25 that is located in front of the brush 13 and extends at least the transverse width thereof. That is, the distributor is located to discharge liquid on the surface to be cleaned forwardly of the brush 13 in the normal forward direction of motion of the machine as indicated by arrow 26. As examples of suitable machines on which this invention may be used, the squeegee assemblies may be mounted on the scrub head unit of the scrubbing machine disclosed in U.S. Pat. No. 3,833,961, or may be mounted on the rear of the scrubbing unit of the first embodiment of the scrubbing machine disclosed in U.S. Pat. No. 3,702,488, or may be mounted on the scrubbing unit of U.S. Pat. No. 3,824,645. Even though each of the above patents discloses a pair of tubular brushes, it is to be understood that the squeegee assemblies of this invention may be advantageously used on machines that have only a single scrub brush, or machines that have one or more disc shaped scrub brushes, or on machines that do not have a scrubbing tool.

Figure 1:
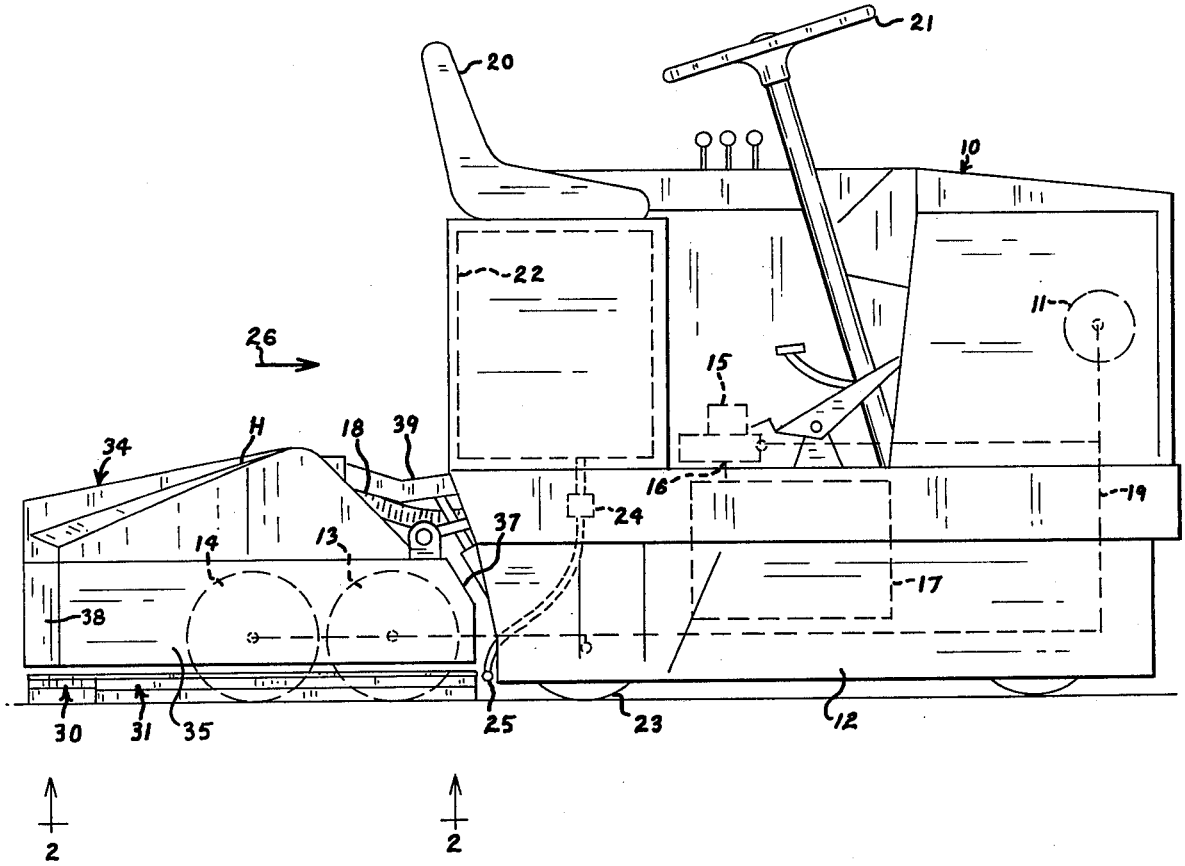
FIG. 1 is a right side view of a scrubbing machine having the first embodiment of the rear squeegee assembly and the side squeegee assemblies of this invention mounted thereon, the scrubber unit housing being shown in a lowered scrubbing position, and parts of the machine being diagrammatically shown.
Figure 2:
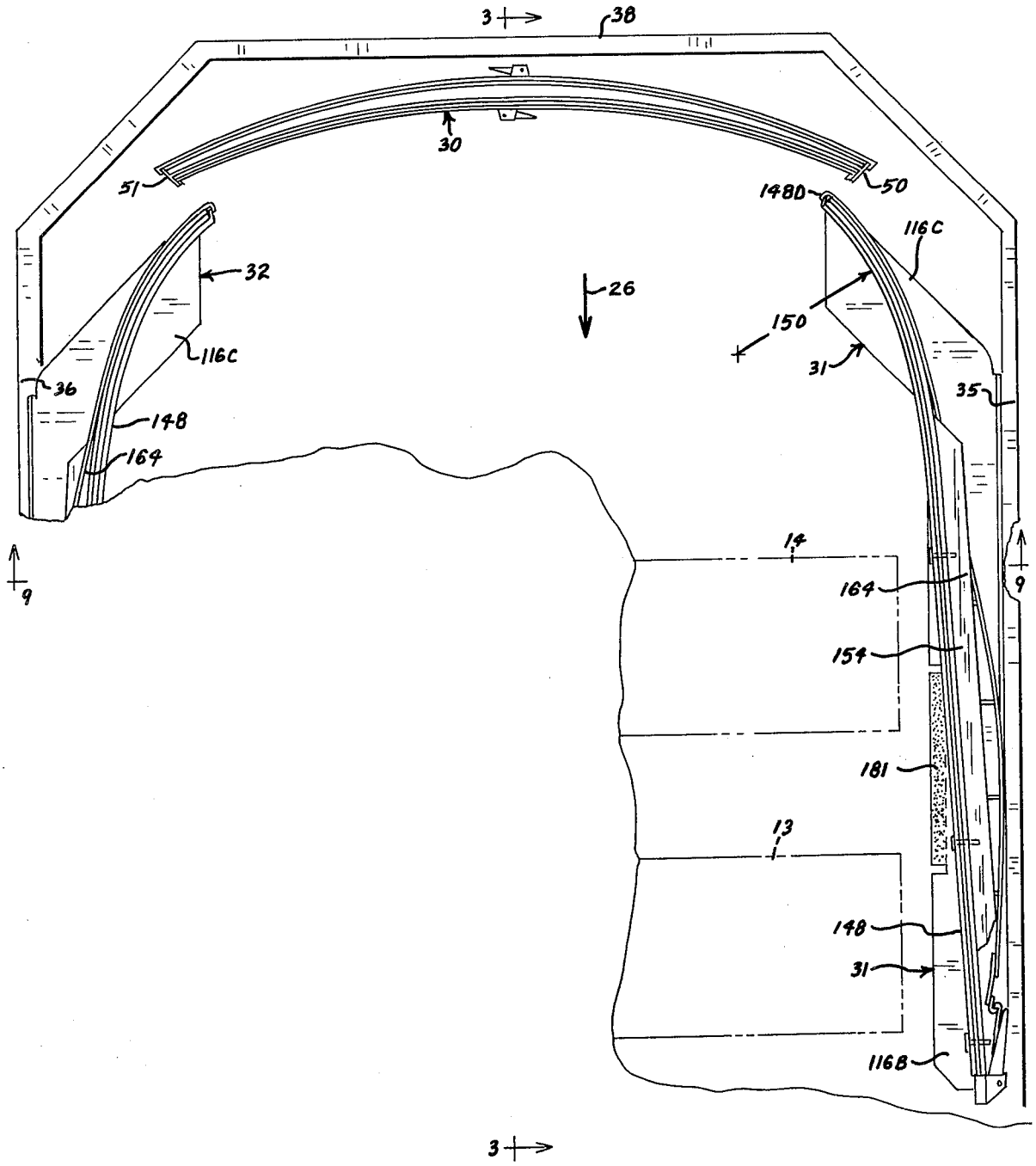
FIG. 2 is a bottom view, generally taken along the line and in the direction of the arrows 2—2 of FIG. 1, to more clearly illustrate the relative positions squeegee assemblies of FIG. 1. Part of one of the side squeegee assemblies is broken away and various details of the construction of the squeegee assemblies and the mounting thereof are not shown.

With reference to the particular machine illustrated in FIG. 1, it includes a scrubber head unit generally designated 34 that includes a housing H that provides a mounting member for the squeegee assemblies, the brush and the liquid distributor. The housing has transversely spaced side walls 35 and 36, a front wall 37, and a rear wall 38. A suitable powered linkage 39, for example of the type described in any one of the patents referred to in the above paragraph, is mounted on the frame and connected to the housing for supportingly carrying the housing in an elevated travel condition, and alternately lowering the housing to a scrubbing position.

Referring now in particular to FIGS. 3, 8, 9 and 10, the rear squeegee assembly 30 includes a squeegee frame 46 that in plan view is arcuately curved and preferably of a parabolic configuration and of a transverse width greater than that of the brushes. The squeegee frame includes a top wall 46*c* having lower surfaces that are sloped downwardly and transversely outwardly from the opening of the squeegee frame outlet 47 through the top wall; the outlet being located on the central portion of the squeegee frame to extend thereabove and have one end of conduit 18 connected thereto. Further, the squeegee frame includes a front wall 46*a* and a rear wall 46*b* that are respectively dependingly joined to the top wall to be in the same longitudinal spaced relationship along the transverse width thereof. The front vertical surface of the front wall and the rear vertical surface of the rear wall provide squeegee backing surfaces and in horizontal cross section are preferably of a parabolic shape. That is, the rear backing is convexly curved while the front surface is concavely curved. Additionally, the squeegee frame includes an end wall 50 and an opposite end wall 51 that are joined to the walls 46*a*, 46*b*, 46*c*. As may be noted in FIG. 8, the rear vertical edge of each end wall is located rearwardly of and transversely outwardly of the respective transverse outer edge of the rear wall while the front vertical edge of each end wall is located a substantial distance forwardly and transversely inwardly of the adjacent vertical edge of the front wall. Thus, the end walls in horizontal cross section are inclined transversely inwardly at varying angles in a forward direction and extend at acute angles relative the adjacent parts of the front and rear wall backing surfaces for purposes that will become more apparent.

The squeegee rear wall has a plurality of transversely spaced stubs 45 that are joined to the vertically intermediate portion thereof to extend generally radially outwardly thereof in a rearward direction for being extended through the squeegee apertures 54 in the rear squeegee 52 to supportingly carry the rear squeegee in a substantially fixed transverse position relative the squeegee frame while it is being clamped to the squeegee frame in a manner to be described more fully hereinafter.

Similarly, a plurality of front studs 76 are joined to the vertically intermediate portion of the squeegee front wall to extend radially outwardly thereof in a forward direction to be extended through the squeegee apertures 54 of the front squeegee 53 for supportingly carrying the front squeegee 53. Preferaly, the squeegees 52 and 53 in a flattened relaxed condition are generally of a rectangular shape, transversely elongated, and made of material such as rubber or a polyurethane or other flexible material that will give slightly and provide a good drying seal against the surface being cleaned. Further, the apertures 54 are only slightly larger than the studs in cross section. The front squeegee may be of a somewhat smaller vertical height than the rear squeegee,, and has transversely spaced vertical slots 53a opening through either just the lower or both transverse edges thereof, there being no such slots in the rear squeegee.

For removably clamping the front squeegee against the front squeegee wall 46*a,* there is provided clamp mechanism, generally designated M, that includes a pair of transversely elongated flexible front bands 66, 67 that have rear surfaces of substantially the same curvature as the front surface of the squeegee frame front wall, other than for the transverse outer ends. Each of these bands has a transverse hooked outer end 66*a,* 67*a,* respectively that is joined to the main body portion of the band to extend transversely inwardly in a forward direction at about the same angle as the respective end wall portion 50*a,* 51*a;* and bear against end wall portions 50*a,* 51*a* respectively and the longitudinally adjacent part of the backing surface to limit the tranverse outer movement of the band tranverse outer end portions when the bands are in a squeegee clamping position. Further, each of the bands includes a plurality of transversely spaced, transversely elongated slots 57 for having the front studs 76 slidably extended therethrough to permit limited transverse movement of the bands relative the squeegee frame while the studs support the bands on the frame. Additionally each band is desirably of an arcuate length that is at least as great as one-half the arcuate length of the squeegee frame front wall. The bands are relatively thin so as to be able to follow the curvature of the squeegee backing surface, but the hooked ends must be strong enough to withstand the bending moments cuased when the bands clamp the squeegee aginst the backing surface.

Figure 18:
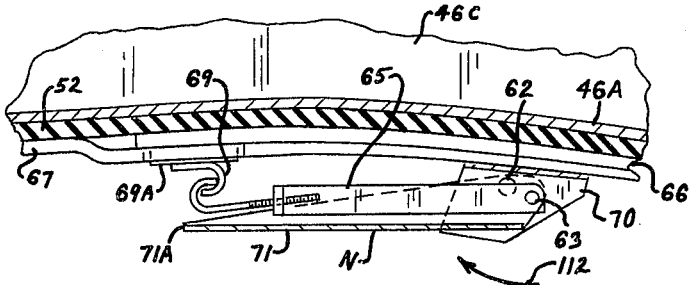
FIG. 18 is a fragmentary, enlarged plan vieew of the overcenter lock mechanism for the front squeegee of the first embodiment of the rear squeegee assembly.
Figure 8:
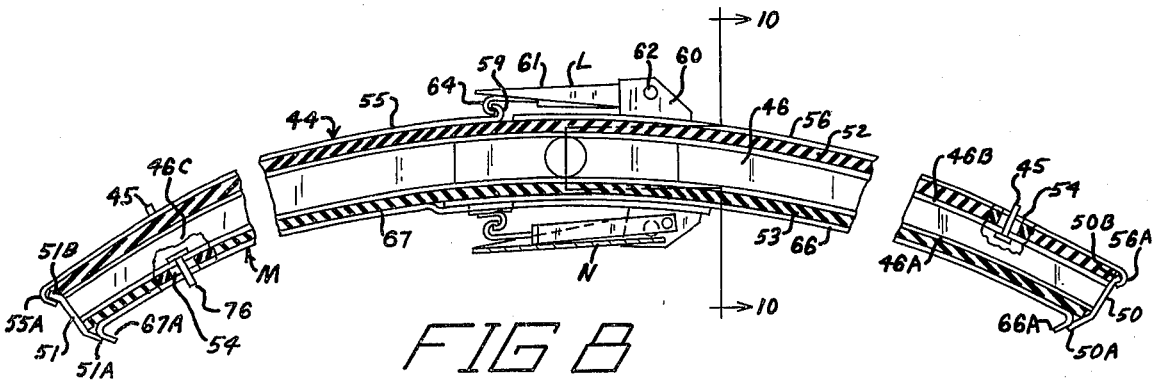
FIG. 8 is a fragmentary, horizontal, cross-sectional view of the rear squeegee assembly, generally taken along the line and in the direction of the arrows 8—8 of FIG. 9, showing the mechanism for releasably retaining the rear and front squeegees on the rear squeegee frame, transverse intermediate portions of said assembly being broken away.

For releasably retaining the front bands in a clamping position (see FIG. 18), there is provided over center latch locking mechanism N that includes a hook 69 that is joined to a sleeve 69*a*that in turn is mounted on the transverse inner end portion of the band 66, a bracket 70 that is mounted on the transverse inner end portion of the band 67, a lever 71 which has one end pivotally connected to the bracket 70 by a pivot member 62, and a latch hook member 65 that has one end pivotally connected at 63 to said one end of the lever 71. The transverse inner end portion of band 67 is slidably extended through sleeve 69*a.* The vertical pivots 62, 63 are located relative to one another such that as the free end 71*a* of the lever 71 is pivoted in the direction of the arrow 112 about pivot 62, the hooked end of member 65 is moved into hooking relationship with the hook 69 whereby the inner end portion of band 67 is moved to be in lesser overlapping relationship to band 66. If the inner ends of the bands are not overlapped, than they are moved further apart when mechanism N is operated to a locking condition. As a result, the bands are placed in compression, provided the hooked ends thereof clampingly bear against the end walls and the front squeegee is between the bands and the front wall 46*a.* As may be noted, due to the provision of the elongated slots in the bands, the bands can move transversely a limited amount relative the front studs when the bands are being placed in compression. As a result of the bands being placed in compression with the squeegee being located longitudinally between the bands and the squeegee front wall, the bands move a limited amount rearwardly so that front squeegee is clampingly retained on the squeegee frame. To be noted is that as the lever is pivoted to a clamping position, pivot 63 is moved to have its axis located relative the axis of the lever pivot that the compression in the bands acts to retain the lever in its clamping position. Due to the curvature of the front wall squeegee backing surface, the greatest clamping pressure is exerted on the squeegee adjacent its transverse outer end portions. Preferably, the locking mechanism N is located about midway between the transverse outer ends of the squeegee frame to minimize the displacements between bands and squeegee which helps minimize the stretching of the squeegee as it is clamped against the squeegee frame. Also, the central location facilitates changing the squeegee. The squeegee may be readily removed by pivoting lever 71 in a direction opposite arrow 112, which permits easily removing the bands from the squeegee frame, and thence the front squeegee being removed.

For releasably retaining the rear squeegee 52 on the rear studs 45 there is provided clamping mechanism, generally designated 44, that is somewhat similar to that for releasably retaining the front squeegee on the squeegee frame. That is, there is provided a pair of transversely elongated bands 55, 56 that are arcuately curved to have about the same curvatures as the rear vertical backing surface of the squeegee rear wall 46*b,* each of the bands having transverse outer hooked ends 55*a,* 56*a* respectively joined to the curved main body portion thereof that are inclined transversely inwardly and forwardly at about the same angle as the transverse outer surfaces of the squeegee end walls that extend rearwardly of the squeegee rear wall. The hooked ends 55*a,* 56*a* in a band clamping position bear against the transverse outer surfaces of the end wall portions and the adjacent part of the backing surface to limit the transverse outer movement of the band transverse outer end portions. Likewise, the bands 55, 56 are provided with over center latch locking mechanism L. The transverse inner end of band 55 has a hook 59 integrally joined thereto while the transverse inner end portion of band 56 mounts a bracket 60 of mechanism L which in turn has one end of the lever 61 pivotally connected thereto by a pivot 62. The lever 61 has one end of the latch hook member 64 pivotally connected thereto by a pivot 63 (same as for mechanism N), the opposite end of member 64 being of a hook shape for hookingly engaging the hook 59 and being moved between a rear squeegee clamping position and a rear squeegee release position in a manner similar to that described with reference to the front squeegee over center latch mechanism, except that instead of the rear bands being placed in compression, the rear bands are placed in tension. That is, as the lever 61 is moved to the latch locking position of FIG. 8, the adjacent transverse inner edges of the rear bands are moved more closely adjacent one another if the transverse inner end portions of the bands are not overlapped when in a non-clamping position while the hook ends 55*a,* 56*a* of said bands are forced transversely inwardly, and as a result of the hook ends abutting against end walls the bands tend to or do move slightly forwardly for clamping the rear squeegee against the squeegee frame rear wall backing surface. Advantageously, the bands 55, 56 are of about the same length as are the bands 66, 67 so that the respective over center latch mechanism in a locked position is located transversely about midway between the transverse outer ends of the rear squeegee frame.

Figure 10:
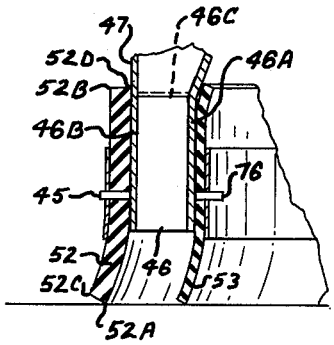
FIG. 10 is a fragmentary, longitudinal cross-sectional view generally taken along the line and in the direction of the arrows 10—10 of FIG. 8 for further illustrating the construction of the rear squeegee assembly.

It is to be noted that the rear squeegee is of generally rectangular shape, and has four transversely elongated edge corner 52A, 52B, 52C and 52D respectively. Thus, with the squeegee mounted as shown in FIG. 10, corner 52A is the lower front edge corner; however, by turning the rear squeegee 180°about its vertical center axis, edge 52C will be the lower front edge; or alternately by turning the rear squegee 180°about its axis of elongation, corner 52B will be the lower front edge. Thus, the squeegee can be mounted in a position that each of its four corner edges be utilized as a lower front edge which is subject to the greatest amount of wear. Thus, the squeegee has a longer effective life than for conventional squeegee wherein the squeegee can be readily mounted in one or two positions in contrast to the four working positions for squeegee 52.

In order to mount the rear squeegee assembly on the housing for movement between an elevated position and a lowered position to have the squeegee engage the surface to be cleaned, a bracket 72 is welded to each squeegee frame end wall to extend thereabove at a location transversely inwardly of and adjacent the respective housing side wall. Each bracket 72 mounts a pair of vertically spaced transverse pivots 74, each pivot 74 mounting the one ends of the parallel arms 73. The opposite ends of the arms 73 are pivotally connected to the side walls 35, 36 at 75 whereby the arms are mounted in parallel relationship to extend forwardly of pivots 74.

For moving the rear squeegee assembly between a lowered squeegeeing position and an elevated position, and selectively retaining the rear squeegee assembly in an elevated position relative the housing, there is provided a piston-cylinder combination 81, 82 that includes a cylinder 81 mounted by the housing and a depending piston rod 82 that extends through a longitudinally elongated slot 80 in a bracket 79 that is attached to the squeegee outlet 47 to extend rearwardly therof. A lug 83 is secured to the lower end of the piston rod 82 to abut against the under surface of the bracket 79 for raising the squeegee assembly and at the same time permitting the squeegee assembly to move freely in an upward direction relative the housing when the piston rod is in its extended position. The combination 81, 82 is a two way acting combination, valved lines 84 being connected to a suitable scource of fluid under pressure and to the ends of the cylinder for selectively elevating the piston rod and lowering the piston rod.

In order to retain the front and rear squeegees in engagement with the surface at a nearly constant pressure within limits of the vertical movement of rear squeegee assembly relative to the housing even though the elevation of the housing relative the surface varies, there are provided scissor action assemblies 89 and 90 respectively. The scissor action assembly 89 is located transversely between the rear squeegee assembly outlet and the housing right side wall while the assembly 90 is located transversely between the outlet and the housing left wall. Since each of the asemblies 89, 90 is of the same construction, for the most part, only one of the assemblies will be described. The assembly 89 includes a bracket 91 secured to the rear squeegee frame. If the rear squeegee is of parabolic shape, preferably the brackets 91 are secured to the rear squeegee frame to apply a downward force thereto such that the lines of force are located closely adjacent the intersections 267 of the center axis of squeegee deflection 226 and the effective line of force 265 as described with reference to FIG. 17. Each bracket has an upwardly extending flange which mounts a pivot member 94 to have its pivot axis extend horizontally and generally radially relative the curvature of the rear squeegee frame, the pivot member pivotally mounting the lower ends of the arms 92, 93 which extend upwardly therefrom in opposite directions. The opposite ends of each of the arms 92, 93 mounts a pivot member 101, one pivot member 101 mounting the lower end of an arm 95 while the other pivot member pivotally mounts the lower end of an arm 96. The opposite ends of the arms 95, 96 are pivotally attached at 97 to the upper part of the housing rear wall or a bracket mounted on the housing rear wall or top wall. Arms 93, 96 are parallel to one another and arms 92, 95 are parallel to one another. Also, the pivot axes of pivots 94, 97, 101 are parallel to one another, and the spacing of pivot 94 from pivot 101 is the same as the spacing of pivot 101 from pivot 97. Each of the pivot members 101 pivotally mounts a plate 98 that has a plurality of apertures 99 of varied spacing from the respective pivot member 101. A coil spring 100 has its one end portion extended through an aperture 99 in one plate and its opposite end portion extended through an aperture in the other plate 98. As a result, the coil spring constantly resiliently urges the plates 98 and pivots 101 to move toward one another and through arms 92, 93 to move the pivot member 94 downwardly relative the pivot member 97. The characteristics of the springs 100, the mounting thereof, and the lengths of the scissor arms 92, 93, 95, 96 are such that when the squeegees of the rear squeegee assembly engage the surfce being maintained, a nearly constant downward force is exerted against bracket 91 even though the vertical spacing of pivot member 94 from pivot member 97 is varied because of variations in spacing of pivot 97 from the surface. The provision of a number of apertures 99 in the plate 98 facilitates mounting the spring in a position for obtaining the aforementioned nearly constant downward force. Lug 83 in its extended position limits the downward movement of the rear squeegee assembly relative the housing so that spring 100 is always in tension.

There is sufficient play between the pivotal connection of the parallel arms 73 to the bracket 72 and the parallel arms to the housing side walls that one transverse end of the rear squeegee assembly may be moved to a substantially higher or lower elevation than the opposite transverse end even though the housing is in a generally horizontal condition. Further, the scissor action assemblies permits the elevation of one end of the rear squeegee assembly varying relative the elevation of the housing even though the opposite end is maintained at a nearly constant height relative the housing, and at the same time maintains a nearly constant downward pressure across the transverse width of the rear squeegee assembly. Thus, the scissor action assemblies maintain the lower edges of the rear squeegee assembly squeegees against the surface being cleaned under nearly contant pressure even though the elevation of the housing varies relative the surface and/or elevation of one housing side wall varies relative the surface while the other side wall remains at a nearly constant elevation relative the surface. That is, the vertical spacing of pivots 94, 97 of one of the assemblies 89, 90 may vary considerably while the vertical spacing of the other pivots 94, 97 remains nearly constant; or the spacing of one set of pivots 94, 97 may increase while the other decreases, or the spacing of both sets may vary in the same direction, depending on the change of the spacing of the rear portion of the housing from the surface being cleaned, and the change of the transverse slope of the surface. As a result, a more even squeegee action is obtained without the requirement of excessive downward pressure being exerted against the rear squeegee assembly, including any transverse portion thereof, and permits the machine traveling at a higher speed and still obtain good squeegee wiping action. This also helps minimize wear of the front and rear squeegees while at the same time obtaining more even pickup of liquid across the transverse width of the rear squeegee assembly.

The side squeegee assemblies 31, 32 are mounted on the side walls 35, 36 respectively of the housing, and advantageously on side doors (**35*a* for wall 35) that form part of the respective side wall. Since basically each of the side squeegee assemblies 31, 32 is of the same construction, other than one is a left hand assembly and the other is a right hand assembly, primarily only the construction of the squeegee assembly 31 will be described. Referring now in particular to FIGS. 2–6, the side squeegee assembly 31 includes a longitudinally elongated squeegee frame 116 that has an upwardly extending flange 116*a*. One end of an arm (link) 117 is pivotally connected at 118 to flange 116*a* while the opposite end of the arm is pivotally connected at 119 to the housing side wall 35. Pivot members 118, 119 have parallel transverse pivot axes, pivot member 118 being located at the front end portion of the flange member. Adjacent the rearward edge portion of the flange member, a transverse pivot member 123 pivotally mounts one end of an arm (link) 124, the opposite end of the arm having a lug 126 joined thereto to extend outwardly thereof at generally right angles to the direction of elongation of arm 124. Likewise, one end of an elongated arm 128 has a lug 127 joined thereto to extend outwardly thereof at generally right angles to the direction of elongation of the arm 128. The ends of the lugs 126, 127 remote from the arms 124, 128 respectively are pivotally connected by a transverse pivot member 125 while the end of the arm 128 remote from lug 127 is pivotally connected to the side wall 35 by a pivot member 129 (pivot member 129 for assembly 32 being mounted by side wall 36). As may be noted from FIG. 3, pivot member 119 is located at a substantially lower elevation and a substantial distance longitudinally forwardly of the pivot member 129 while the straight line spacing between pivot members 119, 129 is substantially greater than the straight line spacing between pivot members 118, 123. Pivot members 118, 119, 123, 125 and 129** have parallel pivot axes.

A lug 135 is secured to arm 128 (or lug 127) to be forwardly of pivot member 125. One end of a coil spring 131 is mounted by lug 135 at a location vertical between arms 124, 128, the opposite end of the spring being mounted by a lug 132 that is forwardly of lug 135. Lug 132 is pivotally mounted on the adjacent housing side wall by a pivot 133 which has a horizontal pivot axis. A set screw 137 is threaded in a bracket mounted on the housing to have one end abut against a bracket 140 that is welded to lug 132, the spring constantly resiliently urging the lug 132 to pivot in the direction of arrow 113 to retain the bracket 140 in abutting relationship with the set screw. By turning the set screw in the appropriate direction, the spring tension is increased, or decreased, which acting through arms 124, 128 increases, or decreases, the down pressure on squeegee 152 at the surface being cleaned. The arms 124, 128, 117, the characteristics of the spring 131, and the mounting thereof are such that when the squeegee 152 of the side squeegee assembly engages the surface being cleaned, a nearly constant downward pressure is maintained on the squeegee even though the spacing of either end of the squeegee frame is more greatly varied from the lower edge of the housing than the opposite end, or the spacing of both ends is varied the same amount.

A stop 138 is mounted on the adjacent housing side wall for abutting against arm 128 (or lug 127) to limit its pivotal movement in the direction of arrow 139 about pivot 129 to a position that the arm extends downwardly and rearwardly from said pivot; a position that spring 131 is still in tension; and a position that precludes arms 128, 124 pivoting about their respective pivots to a position that the pivot axis of pivot 125 is located in or forwardly of the plane of the pivot axes of pivot members 123, 129; i.e. prevent pivot axis 125 moving forwardly of said plane. The arms 124, 128 are movable to be parallel to one another, and normally converge in a rearward direction. Spring 131 acts to force pivot 125 forwardly and thereby pivot 123 downwardly. The forward force of the spring action is transmitted through the mounting linkage of the rear portion of the side squeegee frame and link 117 whereby a downward component of force is exerted on the squeegee frame at 118. The stop 138 limits the downward movement of the squeegee frame relative to the housing A forward stop 141 is mounted on the respective housing side wall to limit the rotation of arm 117 about pivot 119 in the direction of arrow **139*a*. Stops 141, 138** effectively establish a lower limit of downwardly travel of the side squeegee assembly relative the housing, the lower limit position being lower than any normal operating position of the squeegee assembly.

With the above mentioned mounting of the side squeegee frame, within the limits of vertical movement of the side squeegee frame, a nearly constant downward force is exerted on the side squeegee 152 along the length thereof while at the same time the vertical spacing of pivots 123, 129 may be varied considerably with only a small variation of the vertical spacing of pivot 118 from the lower edge of the housing side wall; or the vertical spacing between the lower edge of the housing side wall and pivot 118 may be varied considerably with only a small variation in the vertical spacing of pivots 123, 129; or the vertical spacing of pivot 123 from 129, and pivot 118 from the housing side wall lower edge may be varied considerably or only lightly as the side squeegee assembly moves along the surface. Thus, the side squeegee assembly can, within limits, move vertically to follow a surface even though the elevation either/or both of the longitudinal ends of the housing side wall varies relative the surface being cleaned.

The downward force exerted by the spring urged linkage of this invention on the front part of the side squeegee assembly is less than that exerted on the rear part thereof, part to compensate from the tendency of the front part to wear fast due to any lack of water lubrication, and part to facilitate the side squeegee 152 moving over a heavy object or one fastened to the surface being cleaned. The spring action is such to urge the rear part of the squeegee assembly downwardly and forwardly, which through the front link 117 urges the front part downwardly.The downward downwardly. The exerted on both the front and rear end portions respectively of the side squeegee assembly are nearly constant within the limits of vertical movement of the squeegee assembly relative the housing as long as the squeegee frame remains substantially parallel to the housing and the surface being cleaned. When the front part or front edge of a side squeegee 152 hits an obstruction that does not move and dows not extend up to the level of the lower part of the squeegee frame, instead of the obstruction causing the side squeegee to tear, the side squeegee can move over the obstruction. That is, the rearward force exerted on the side squeegee by the obstruction will result in link 117 pivoting clockwise as viewed in FIG. 3 to elevate the front end of the side squeegee assembly so that the squeegee moves over the obstruction rather than tearing.

The side squeegee frame includes a generally longitudinally elongated horizontal plate portion **116*b* that is integrally joined to the lower edge of flange 116*a* to extend transversely inwardly thereof, and at its rearward end is integrally joined to extension portion 116*c* which extends further transversely inwardly and rearwardly of the plate portion 116*b*, Flange 116*a* extends parallel to and transversely adjacent the adjacent housing side wall portion 35*a* while portion 116*c* extends a substantial distance further inwardly of the side than plate portion 116*b*. Welded to the plate portion 116*b* and extension 116*c* to extend downwardly therefrom is a metal squeegee backing strip 148, the front vertical edge 148*a* of the backing strip extending downwardly from plate portion 116*b* and transversely outwardly at a rake angle of, for example, about 75° (i.e. an angle a of about 15° from the vertical). A substantial distance rearwardly of edge 148*a* at line 148*b*, the backing strip extends downwardly at an angel of 90° relative to plate portion 116*b*. In a rearward direction from edge 148*a* to line 148*b* the backing strip angle, which is complementary to angle A, gradually increases from about 75° to 90°, while from line 148*b* to the rear vertical edge 148*d* of the backing strip, the aforementioned angle is 90°. The upper edge of the backing strip extends horizontally in a straight line from edge 148*a* to line 148*c* which is intermediate line 148*b* and edge 148*d* (for example, an included angle D of about 3° between said upper edge and the machine travel direction) while from line 148*c* to the backing strip rear vertical edge, the upper edge of the backing strip is curved about a radius of curvature 150 to extend further transversely inwardly and rearwardly. A plurality of longitudinally spaced studs 149 are secured to the backing strip to extend perpendicular thereto in a generally transverse outwardly direction, the studs being extendable through apertures 153 of the side squeegee 152 and the resilient back up squeegee blade 152*a*, if provided, for supportingly holding the side squeegee on the squeegee frame. For purposes for further description it will be considered that the blade 152*a* and squeegee 152** are a single member, the side squeegee is advantageously made of the same type of material as the front and rear squeegees.

Figure 7:
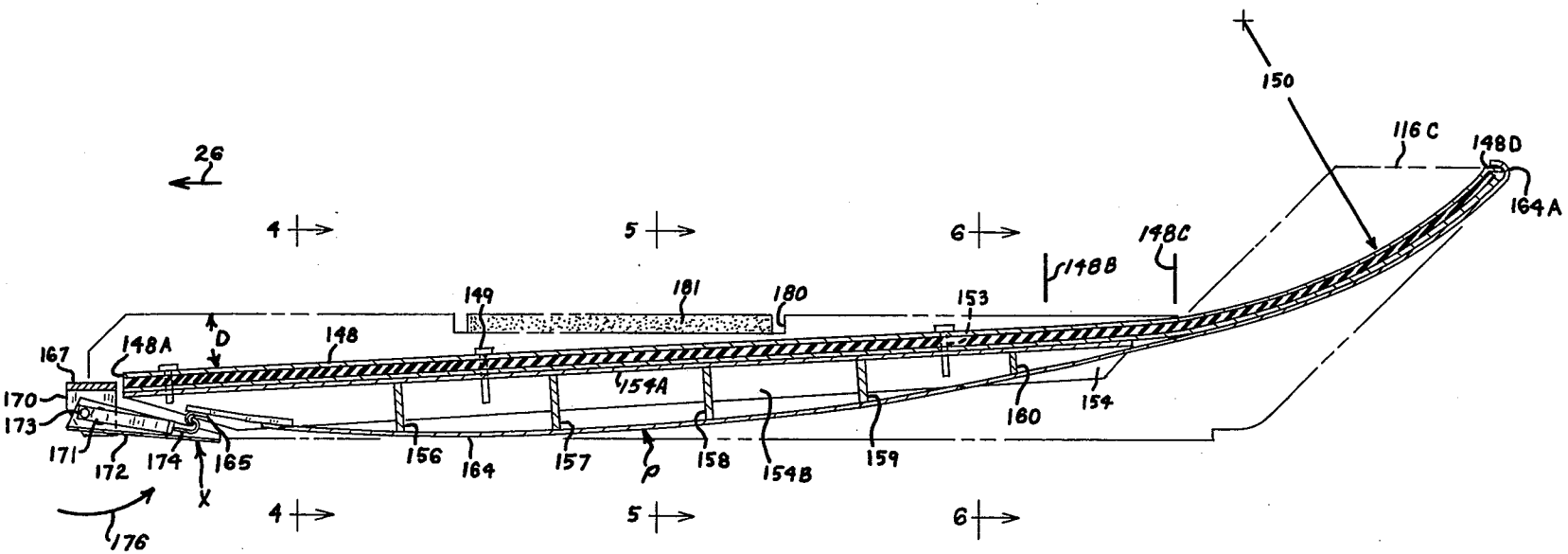
FIG. 7 is an enlarged horizontal, cross-sectional view of one of the side squeegee assemblies to more clearly illustrate the mechanism for releasably retaining the side squeegee on the side squeegee frame, said view being taken along the line and in the direction of the arrows 7—7 of FIG. 3 just below the side frame and the side frame being shown in phantom.
Figure 9:
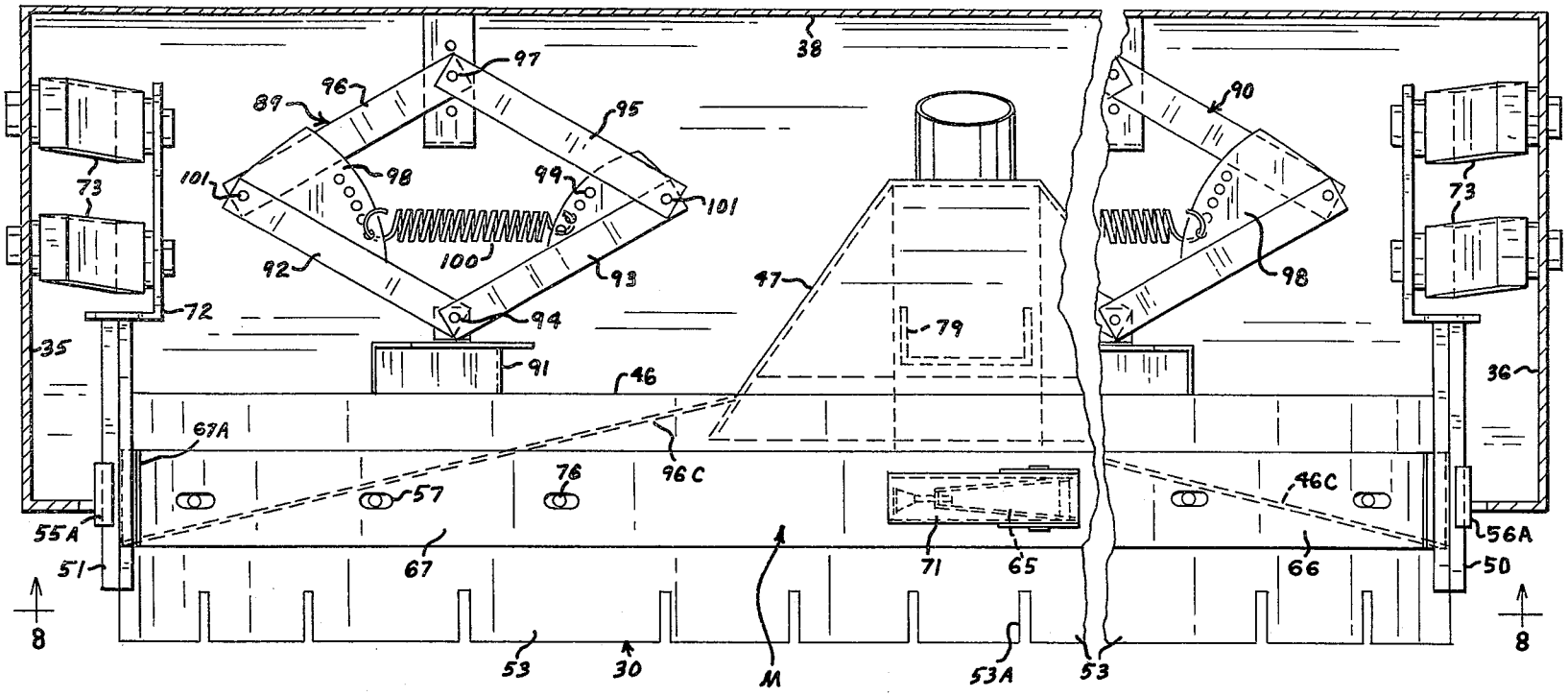
FIG. 9 is a transverse, vertical cross-sectional view generally taken along the line and in the direction of the arrows 9—9 of FIG. 2 to show the rear squeegee assembly and the mounting thereof on the scrubber unit housing, the side squeegee assemblies not being shown.

For releasably retaining the side squeegee on the squeegee frame there is provided clamp mechanism P that includes a longitudinally elongated angle iron 154 that has a horizontal leg **154*b*, a generally vertically extending leg 154*a* that is convoluted to form a mating fit with the transversely adjacent parts of the backing member 148, and apertures 155 in the vertical leg for having the studs 149 extended terethrough to retain the member 154 in a fixed longitudinal position relative backing strip 148. A plurality of longitudinal spacer angle members protrusions 156–160 have their one vertically extending edges welded to the vertical leg 154*a* and opposite vertical terminal edges (extending at right angles to plate portion 116*b* ) transversely outwardly of leg 154*a*. The spacer members 156–160 are parallel to one another, and are of varying lengths so that the terminal vertical edges thereof remote from angle iron leg 154*a* are located along the periphery of a circular cylinder having a central vertical axis that is located transversely on the opposite side of leg 154*a* from the spacer members. Thus, for example, the horizontal length of the longitudinally central spacer member 158 is longer than that of each of the corresponding spacer member 157 and 159 that are on either longitudinal side thereof while the spacer members 156 and 160 are shorter than the corresponding spacer members 157 and 159. As may be noted from FIG. 7, the longitudinal length of the angle iron 154 is substantially smaller than the length of the backing strip and terminates forwardly of line 148*c*. Additionally, for space limitations, the radius of curvature for the above mentioned cylinder is substantially greater than the radius of curvature of backing strip section 148*c*–148*d*.**

In order to releasably retain the clamp member 154–160 on the squeegee frame, there is provided over center latch locking mechanism X that includes a flexible vertical 164 that has a hooked end **164*a* for hookingly engaging the edge 148*d* of the backing strip. On the opposite end of the band, there is provided a clip hook 165 that forms a part of the over center latch locking mechanism. The latch locking mechanism incldes a bracket 170 that is bolted to an ear 167 that is dependingly secured to the plate portion 116*b* at a position just forwardly of the front edge of the backing strip. Bracket 170 has one end of a lever 172 pivotally connected thereto by a vertical pivot member 171. One end of latch hook 174 is pivotally connected at 173 to the lever, the pivot axis of pivot 173 being horizontally spaced from the pivot axis of pivot member 171. The end of the latch hook opposite pivot 173 is shaped for hookingly engaging the clip hook 165.**

In use, for mounting the side squeegee 152 on the squeegee frame, first the side squeegee is positioned to be supportingly held thereon by studs 149 extending through apertures 153. Thereafter, the clamp 154 is positioned to have the studs extend through slots 155 with the surface of the leg 154*a* abutting aginst the squeegee and the spacer members 156–160 extending away from the backing strip. Then the hooked end of band 164 is positioned for hookingly engaging the edge portion 148*d* and the intermediate portion abutting against the transverse outer vertical edges of spacer members 156–160. Thence, with the lever in its release position, the latch hook 174 is positioned to hookingly engage the clip hook 165, and thereafter, the lever is pivoted in the direction of the arrow 176 about pivot member 171 to its over center locking position. As the lever is moved to its over center locking position, the band is placed in tension and exerts a force on the vertical edges of the spacer members 156–160 to force leg 154*a* into clamping engagement with the squeegee for clamping the squeegee between said leg 154*a* and the backing strip 148. In this connection, it is to be noted that since the spacer members are longitudinally spaced, the clamping force is exerted on the leg 154*a* at a number of spaced locations. Due to the relative location of the pivot axes of pivots 171, 173, when the lever is in its clamping position, the band under tension acts to retain the lever in its clamping position in the same manner set forth relative the over center locking mechanism for the rear squeegee.

At a location rearwardly of the angle iron 154, the band curves inwardly sufficient to clampingly engage the rear part of the squeegee to clamp it against the section 148*c*–148*d* of the backing strip. Due to the curvature of the backing strip, the side squeegee from front edge 148*a* to line 148*c* extends predominantly rearwardly at an angle to be progressively more closely adjacent the path of travel of the brushes over the surface while the rear portion of the squeegee is curved inwardly to extend a substantial distance transversely inward of the adjacent transverse outer terminal edge of the rear squeegee assembly and the adjacent part of brush 14, and longitudinally spaced therefrom.

The transverse inner, longitudinal intermediate portion of plate portion 116*b* has a notch 180 for mounting a row brush 181 to span the gap between brushes 13, 14 for retaining most solid matter between the brushes 13, 14, the row brush being transversely between the side squeegee and the adjacent transverse ends of the brushes 13, 14. The side squeegee extends forwardly of, and transversely outwardly of brush 13 in both its vertical limit positions relative the housing. The side squeegee contains the liquid on the surface therebetween and directs the liquid not raised by the brushes and directed into a conventional receptacle (not shown) in the housing to a position to be collected by the rear squeegee assembly. With the vacuum system operating and the rear squeegee assembly in its surface squeegeeing position, liquid enters the vacuum channel formed by the rear squeegee frame, the rear squeegee and the front squeegee to be drawn through the outlet 47 and into the dirty liquid collection tank.

When the housing is in its travel position, and even with the piston rod 82 in its extended position, the rear, front and side squeegees are held vertically spaced from the surface. When the housing is in its lowered scrubbing position, and piston rod 82 in its retracted position, the rear and front squeegees are vertically spaced from the surface, but the side squeegees are in contact with the surface.

Figure 11:
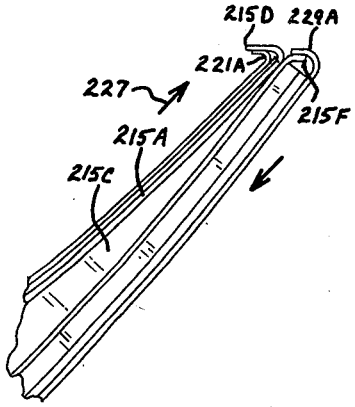
FIG. 11 is a somewhat diagrammatic plan view of the second embodiment of the rear squeegee assembly of this invention.
Figure 11:
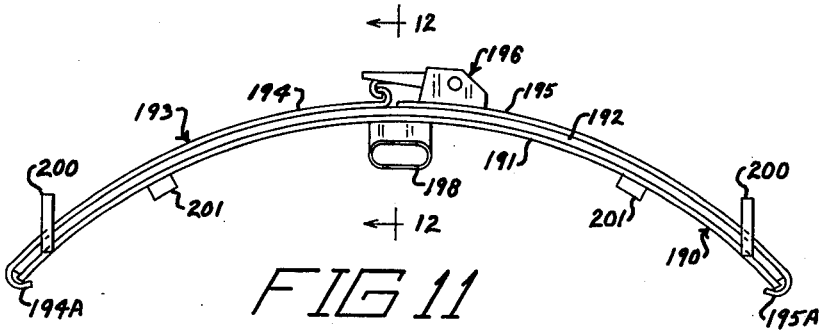
Figure 12:
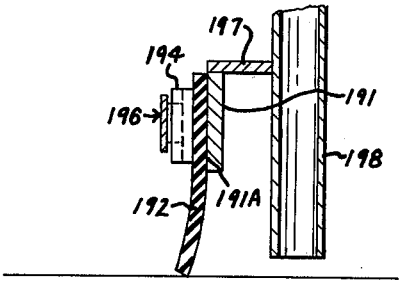
FIG. 12 is a longitudinal cross-sectional view generally taken along the line and in the direction of the arrows 12—12 of FIG. 11.

Referring now to FIGS. 11 and 12, the second embodiment of a rear squeegee assembly of this invention, generally designated 190, includes a transversely elongated squeegee frame 191 that may be an arcuate plate having a convexly curved vertical rear squeegee backing surface 191*a* and transversely spaced studs (not shown) extending radially outwardly therefrom in a rearward direction such as described with reference to the rear studs for squeegee assembly 30. Preferably the squeegee frame is parabolic in plan view. The studs extend through squeegee apertures (not shown) for supporting a squeegee 192 while it is being clamped against the backing surface 191*a.* The clamping mechanism, generally designated 193, includes a pair of transversely elongated flexible bands 194, 195 having arcuately curved squeegee engaging surfaces and hooked transverse outer end portions 194*a,* 195*a* respectively for hookingly engging the respective transverse outer end portions of the squeegee frame and transversely elongated slots (not shown) for the studs to extend through such as described with reference to bands 55, 56. Mechanism 193 includes over center latch locking mechanism, generally designated 196, which is mounted on the transverse inner end portions of the bands 194, 195. Clamp mechanism 193 is of the same construction and functions in the same manner as clamp mechanism 44.

A bracket 197 is secured to the transversely centered portion of the squeegee frame to extned forwardly thereof and has a liquid pickup tube 198 clamped thereto by conventional clamp structure not shown. The inlet end of the tube terminates at a slightly higher elevation than the lower edge of the squeegee and is located a short distance forwardly of the transverse central portion of the squeegee. The opposite end of tube 198 is connected by conduit 18 to the dirty liquid collection tank.

Figure 3:
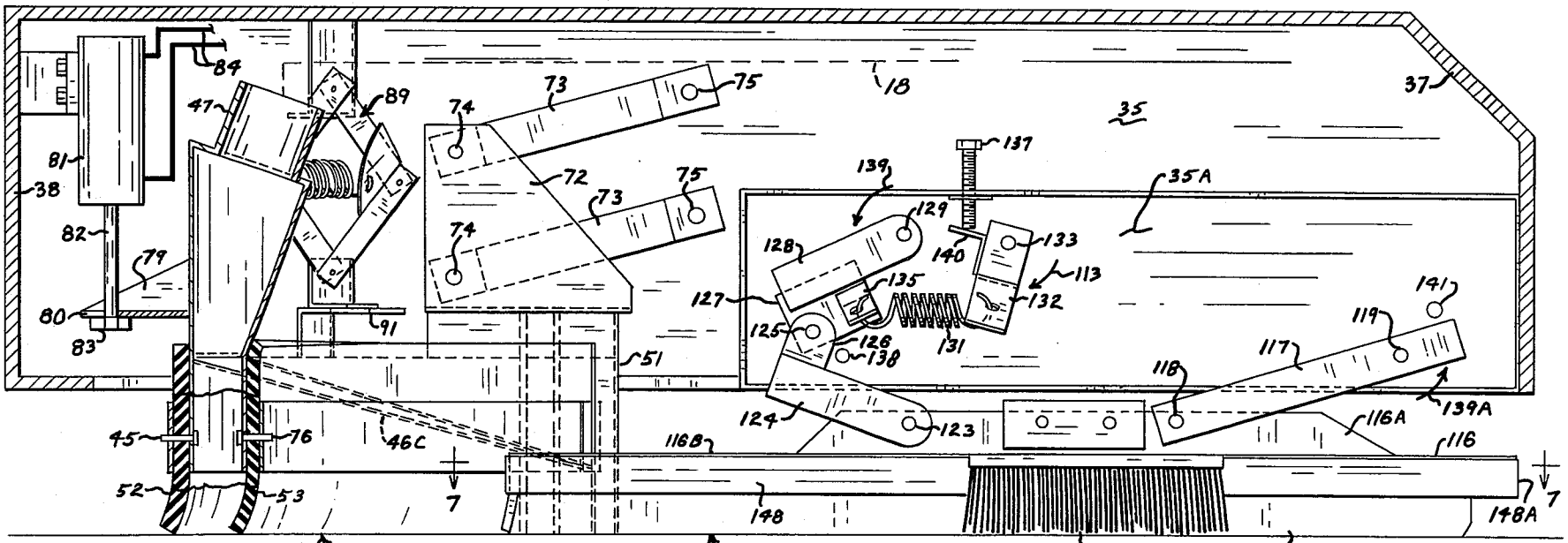
FIG. 3 is an enlarged fragmentary side view generally taken along the line and in the direction of the arrows 3—3 of FIG. 2 to more clearly illustrate the mounting of one of the side squeegee assemblies, and in part the mounting of the rear squeegee assembly.
Figure 4:
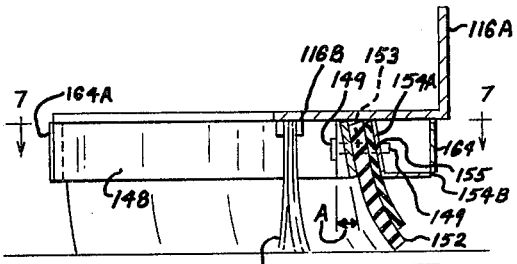
FIG. 4 is a fragmentary transverse cross-sectional view generally taken along the line and in the direction of the arrows 4—4 of FIG. 7 to in part show the contour of a side squeegee in a normal operating position.
Figure 6:
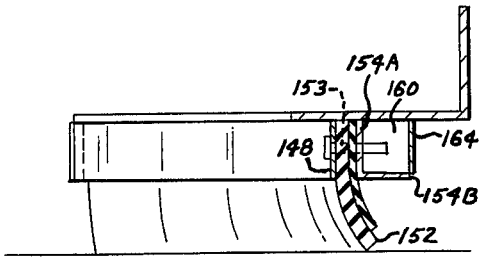
FIG. 6 is a view similar to FIG. 4, other than it is taken along the line and in the direction of the arrows 6—6 of FIG. 7.
Figure 5:
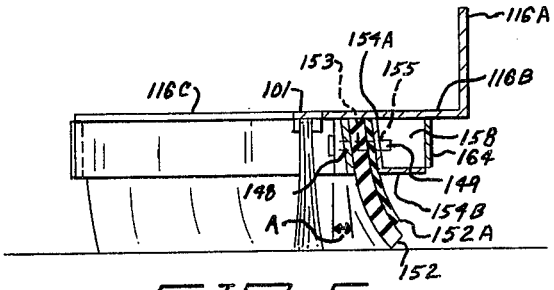
FIG. 5 is a view similar to FIG. 4, other than it is taken along the line and in the direction of the arrows 5—5 of FIG. 7.

Brackets 200 are secured to the transverse outer ends of the squeegee frame to extend thereabove for being pivotally connected by pivot members 74 of FIG. 3 to parallel arms 73. Additionally, a bracket 79 may be secured to the squeegee frame 191 to extend rearwardly for being elevated by members 80–83 such as described with reference to squeegee assembly 30. Brackets 201 are secured to the squeegee frame for having the link arms 92, 93 pivotally connected thereto by pivot members 94 shown in FIG. 9. Thus, the squeegee assembly 190 may be mounted and resiliently urged downwardly under nearly constant pressure in a manner similar to that described with reference to assembly 30.

By having the side squeegees diverge outwardly in a forward direction, straight ahead line contact with the surface. along the length of the squeegee in the direction of travel of the machine is avoided, which reduces streaking on finer finished surfaces. Further, by having the liquid distributor extending transversely to apply liquid in the path of travel of the front edge portions of the side squeegees, the surface adjacent the front of the side squeegees is lubricated to help avoid streaking.

The curved section 148*c*–148*d* is joined to the front section 148*a*–148*b*–148*c* at line 148*c* to extend tangentially relative thereto. As a result, hardening of the squeegee where it is bent is reduced from that which otherwise would occur, and this reduces the posibility of streaks from high down pressure that would be required to force squeegee hard points downwardly with sufficient force for good wiping action.

The convolution of the front squeegee section 148a–148b provides a forced righting of the side squeegee when it folds under from random sidewards movement and the squeegee being folded under on one side of the machine when the machine is being turned. That is, for example, if the side squeegees are mounted on the rear portion of the machine and the side squeegees along the longitudinal length in an elevated condition out of contact with the surface extend at right angles to the surface, when the machine is turned to the left with the right side squeegee squeegeeing the surface, the right squeegee would be folded under to extend transversely outwardly in an upward direction along the length thereof, and relatively frequently when the machine again resumes a straight ahead direction of travel; the right hand squeegee will not resume its normal operating position relative the frame. This is particularly a problem when the side squeegees are inclined relative the direction of travel. When the side squeegee is folded under, frequently streaking occurs, and the wiping action is not as effective as when the squeegee is not folded under.

Figure 15:
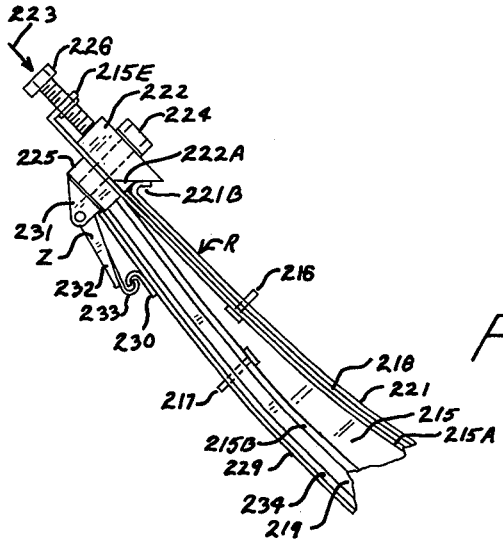
FIG. 15 is a plan view of the third embodiment of the rear squeegee assembly in a lowered squeegeeing position that shows various details of the construction thereof, the transverse intermediate portion being broken away.
Figure 13:
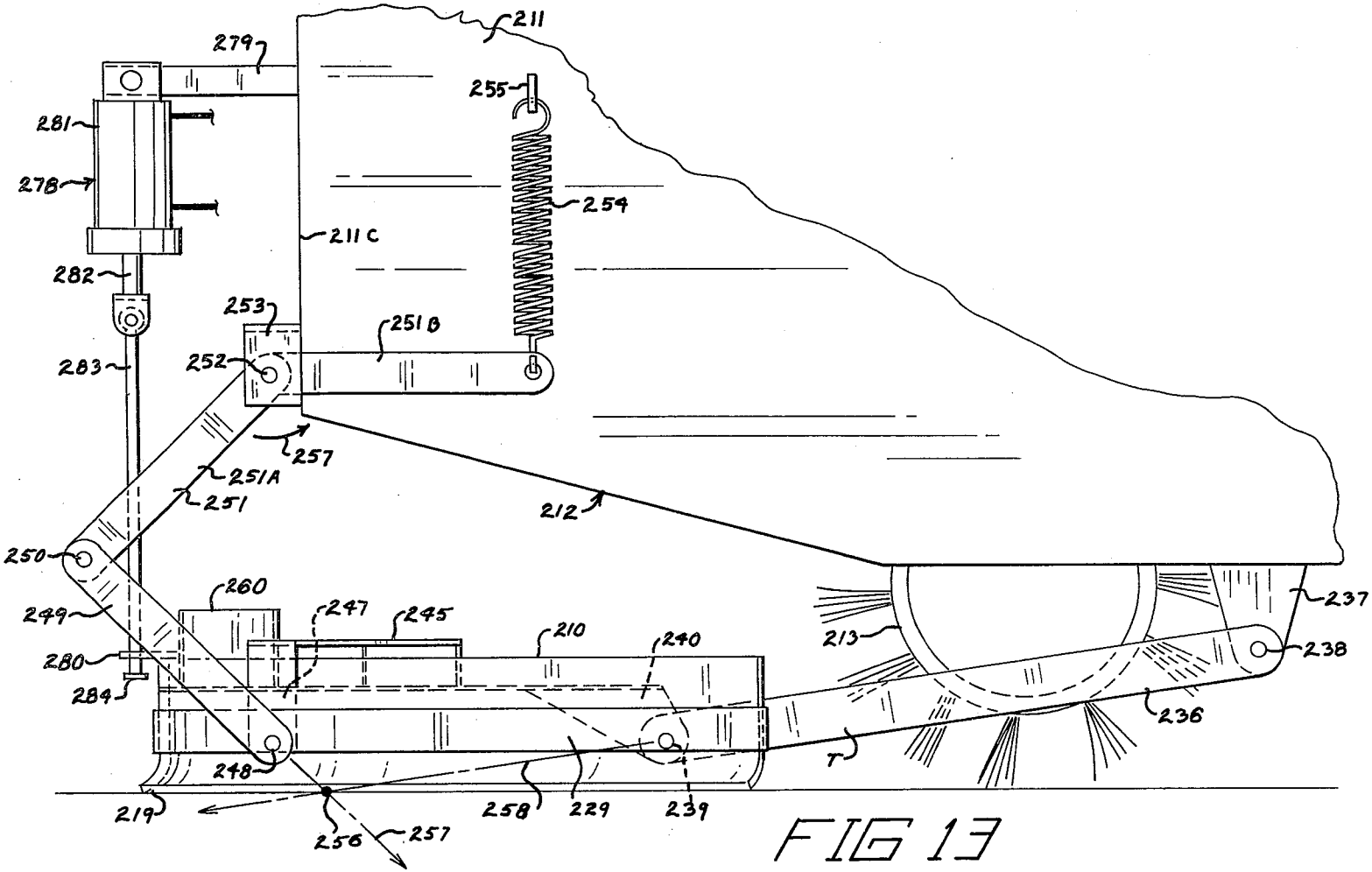
FIG. 13 is a side view of the third embodiment of the rear squeegee assembly and a fragmentary portion of the surface maintenance machine on which it is mounted, said view being generally taken along the line and in the direction of the arrows 13—13 of FIG. 14.
Figure 14:
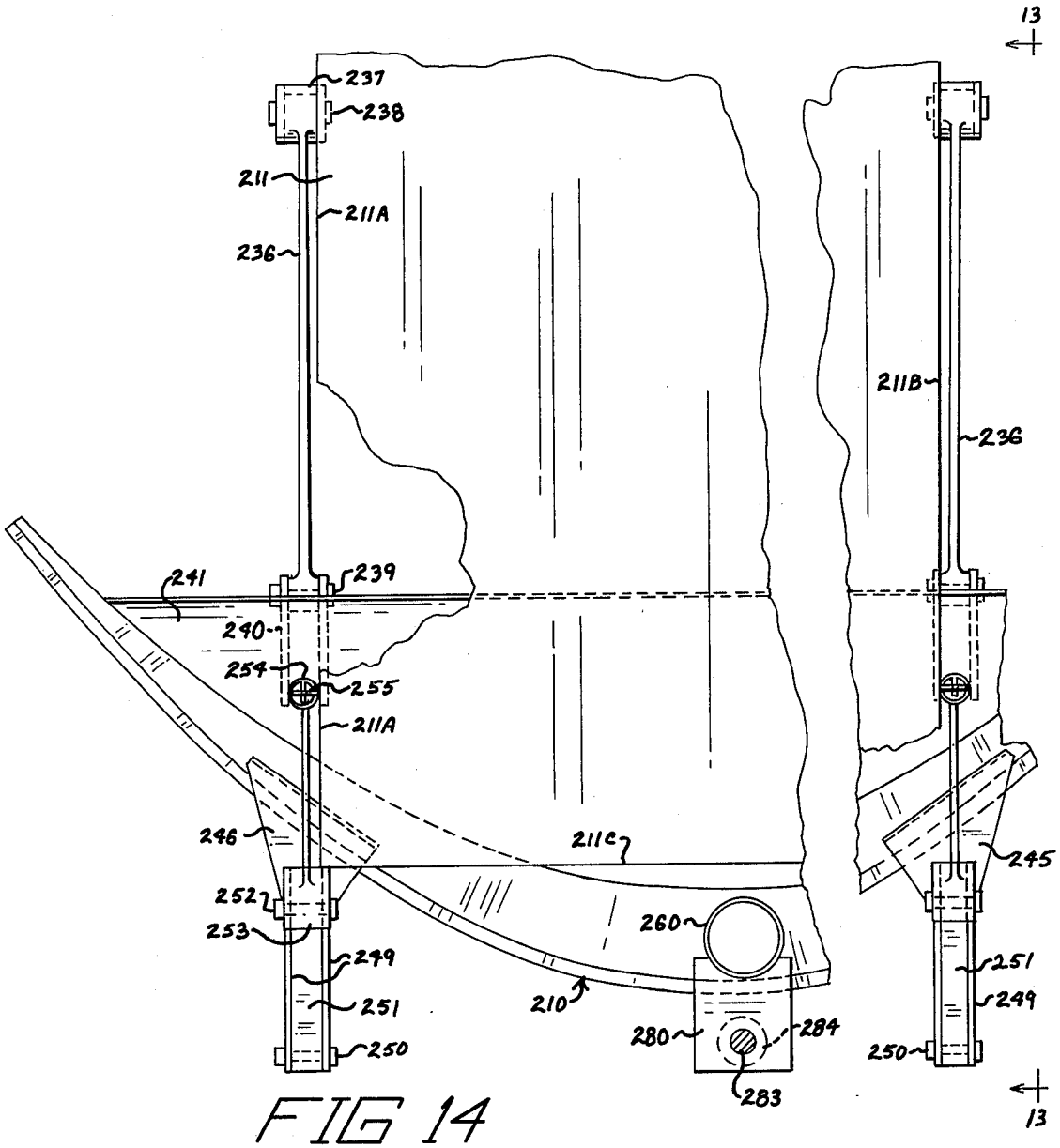
FIG. 14 is a fragmentary plan view of the structure of FIG. 13 with a transverse intermediate portion and one end portion being broken away, details of construction of the squeegee assembly not being shown.

Referring now to FIG. 13–15, the third embodiment of the rear squeegee assembly, generally designated 210, is mounted on a frame member or a suitable part 211, for example a tank, of a surface maintenance machine, generally designated 212 that has a brush 213 mounted in a conventional manner forwardly of said assembly. The squeegee assembly 210 includes a squeegee frame 215 that in plan view, other than tor difference noted hereinafter, is of nearly the same configuration as squeegee frame 46 and includes a top wall 215c, a front wall 215a and a rear wall 215b. Front studs 216 and rear studs 217 are mounted on the front and rear walls respectively to extend radially outwardly thereof for supportingly carrying the front and rear squeegee 218 and 219 respectively as described relative the first embodiment; the squeegees having apertures (not shown) through which the studs extend.

For retaining the front squeegee in compressed abutting relationship with the front squeegee backing surface of the front wall 215a, there is provided clamp mechanism R that includes a transversely elongated flexible front band 221. The front band has transerse hooked outer ends 221a, 221b joined to the opposite ends of the main body thereof to extend generally transversely inwardly, hooked end 221a being abuttable against the rear surface of the generally transversely extending flange 215d that is integrally joined to one transverse outer end of the front wall. The other hooked end 221b is abuttable against the rea, transversely inardly extending edges 222a of the legs of a generally U-shaped taken up bracket (may be a block) 222. The bracket is mounted for movement transversely inwardly and rearwardly in the direction of arrow 223 (and is movable in the opposite direction) by a bolt 224 extended between the legs of the bracket, through an aperture in the front wall 215a and threaded into a block 225. The bolt (and if needed, a washer thereon) retain the bracket 222 in slidable abutting relationship with the front surface of the transverse outer end of the front wall 215a. Transversely outwardly of block 225, the front wall has a flange 215e that threadingly mounts an adjustment bolt 226 to bear against the web of the take-up bracket. By threading the bolt 226 in the appropriate direction the take-up bracket is forced to move in the direction of arrow 223 to place the front band in compression to compress the front squeegee between the front band and front wall 215a; flange 215d limiting the movement of the opposite end of the band in the direction of arrow 227. The band has elongated slots (not shown) for the studs 216 to extend through such as described with reference to the first embodiment.

For clamping the rear squeegee 219 against the rear surface of the rear wall 215b there is provided a transversely elongated rear band 229 having elongated slots (not shown) through which the rear band centering pins (studs) 217 are extended. Bands 221, 229 are transversely curved to correspond to the curvature of the concave and convex squeegee backing surfaces of the front and rear walls respectively of the squeegee frame. The rear band has a hooked end 229a joined to the main body thereof that extends generally transversely inwardly to abut against the front surface of the generally transversely outwardly extending extension 215f that is integrally joined to one transverse end of the rear wall 215b. The opposite end portion of the rear band comprises a clip hook 230 of over center lock mechanism Z, which also includes a bracket 231 that is mounted on block 225. The over center lock mechanism Z is of a construction similar to that of mechanism X and operates in the same way, and includes a lever 232 and a latch hook 233 for hookingly engaging the clip hook. When hooked end 229a hookingly engages flange 215f and lever 232 is pivoted to the clamping position of FIG. 15, the latch hook 233 is moved to place the band 229 in tension to clamp the rear squeegee against the rear wall. Advantageously, a back-up blade (or squeegee member) 234 may be provided betweent the rear band and the rear squeegee 219 such as shown in FIG. 15, the blade being of a material similar to that of the rear squeegee 219, or of somewhat less resiliency, and not extending as great a distance above or below rear pins 217 as the rear squeegee.

Adjacent each transverse side portion 211a and 211b respectively of machine part 211, there is provided spring urged linkage mechanism T for mounting the squeegee frame for limited vertical movement and exerting a nearly constant downward force on the rear squeegee assembly 210. The linkage mechanism T at each side is of substantially the same construction, each linkage mechanism including a bracket 237 mounted on part 211 adjacent the respective side portion 211a, 211b to depend therefrom. The front end of a longitudinally elongated arm (link) 236 is pivotally connected at 238 to bracket 237. the rear end of the arm 236 is pivotally connected at 239 to bracket 240. Brackets 240 are dependingly mounted in transverse spaced relationship to depend from a plate member 241 that is secured to the squeegee frame to extend forwardly of the transverse intermediate rear part thereof, the plate being at a higher elevation than the front sqieegee.

Mounted on the plate 241 in transverse relationship to extend rearwardly of the transversely adjacent part of the rear squeegee assembly are mounts 245, 246, each mount dependingly mounting a bracket 247. The lower ends of arms 249 are pivotally connected at 248 to the respective bracket 247, the upper ends of elongated arms 249 being pivotally connected at 250 to the rear end of section 251a of crank arm 251. The midpart of the crank arm is pivotally connected at 252 to bracket 253, brackets 253 being secured to the rear portion 211c of machine part 211 adjacent the side portions thereof. The lower end of a spring 254 is connected to the front end of the front section 251b of the crank arm, the upper end of the spring being connected to a lug 255 that is welded to the adjacent side portion of part 211. Within the range of limited vertical movement of the squeegee assembly, the springs constantly resiliently urge the crank arms to pivot about pivots 252 in the direction of arrow 257 whereby a downward and forwardly directed force is exerted at pivots 248.

The pivot axes of pivot members 238, 239, 248, 250 and 252 are parallel to one another and extend transversely; pivot members 252 being at a higher elevation than pivot members 238. Within the range of veritical movement of the squeegee assembly, pivot axes 250 are rearwardly of the plane of pivot axes 248, 252, and pivot axes 239, 238 are forwardly of said plane with pivot axes 238 being located substantially fowardly of pivot axes 238 whereby arms 236 extend predominantly horizontally, or horizontally. During normal operating squeegeeing operations, the arms 236 extend downwardly in a rearward direction. The characteristics of springs 254, and the lengths of arms 236, 249 and 251, and pivots 238, 239, 248, 250 and 252 are located such that the downward force of the squeegee assembly is applied at a center line of squeegee deflection (designatd by point 256) that the rear squeegee will deflect across the transverse length thereof and a nearly constant downward force is on the squeegee assembly within the range of limited vertical movement thereof. That is, the linkage mechanism is such that axes or lines of force, designated by arrows 257 and 258, of arms 249 and 236 respectively intersects at the transverse center line of deflector 256 of the rear squeegee. Line 258 passes through pivots 238, 239 and line 257 through pivots 248, 250. With such a suspension, the rear squeegee assembly can follow the surface being cleaned such as described with reference to the first embodiment of the rear squeegee assembly, there being sufficient play of the arms relative to the pivots to permit one transverse end of the rear squeegee assembly 210 raising to a higher elevation than the other.

The rear squeegee assembly 210 has an outlet 260 opening to the vacuum channel of the squeegee frame and adapted to be connected to the vacuum system of the machine as described wit reference to the first embodiment. The outlet is transversely centrally located relative to the transverse outer ends of the squeegee frame. Further, there is provided lift mechanism, generally designated 278 that includes a piston cylinder having a piston rod 282 pivotally connected to a lift rod 283 and a cylinder 281 that is pivotally mounted on a bracket 279 that is attached to rear portion **211*c* of machine part 211. The lift rod slidably extends through an aperture in a bracket 280 attached to outlet 260 and at its lower end mounts a lug 281 to liftingly engage bracket 280. The lift mechanism 278 functions in the same manner as described with reference to the first embodiment. No links such as the parallel links of the first embodiment are provided for mounting the rear squeegee assembly 210.**

The linkage mechanism described with reference to the third embodiment is advantageously used when longitudinal length of the squeegee assembliy (forwardmost part to rearwardmost part) is about equal to or greater than one-half of the width thereof.

Figure 16:
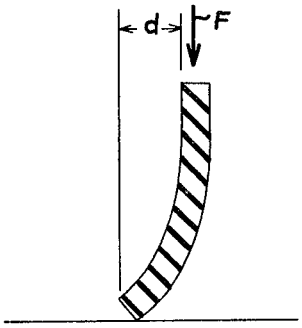
FIG. 16 is a longitudinal cross-sectional view of a rear squeegee of this invention to indicate the deflection thereof during use.

To obtain a desired wiping action on a surface across the length of a squeegee of the blade type such as the squeegees of the rear squeegee assemblies described herein, a downward force has to be applied. As a result of applying the downward force F, during use, the squeegee deflects, the amount of deflection (*d* FIG. 16) being preferably the same across the length of the squeegee. The deflection *d* occurring when the desired wiping action is achieved is primarily dependent on surface or floor friction, the downward force applied to obtain the wiping action, the material the squeegee is made of, and the degree of additional stiffness in the squeegee resulting from its deflecting and any bending of the squeegee along the length thereof due to the manner of mounting.

For a squeegee assembly that is elongated in a direction transverse to the normal direction of travel and curved, or bent, to have transverse opposite ends forwardly of an intermediate part thereof, it is preferred that the squeegee assembly be mounted in a manner that during use, the downwardly force exerted on the squeegee assembly acts against the surface being cleaned such that the pressure acting on the surface in front of a given line at surface level is substantially the same as that rearwardly of said given line, and on a smooth level surface the deflection *d* is substantially the same along each unit length of the squeegee. The given line referred to in the preceding sentence has been designated herein as the "center axis of squeegee deflection".

In order for a rear squeegee assembly to have a free floating action wherein the downward force exerted thereon will result in each unit of length of the rear squeegee along the elongated length thereof deflecting substantially the same amount even though the surface the rear squeegee engages is of varying vertical spacing from the housing or other part of the machine that mounts the squeegee assembly, including the vertical spacing of one end of the squeegee assembly being different from the other end (within the limits of vertical movement of the assembly), the squeegee assembly is mounted so that the downward force is applied (or effectively applied) closely adjacent the center axis of squeegee deflection. In a parabolic squeegee assembly of the first and third embodiments, since the front squeegees have downwardly opening notches extending longitudinally therethrough, most of the downward force applied to the rear squeegee frame is applied through the rear squeegee to the surface being cleaned, and thus the center axis of squeegee deflection is that of the rear squeegee.

Figure 17:
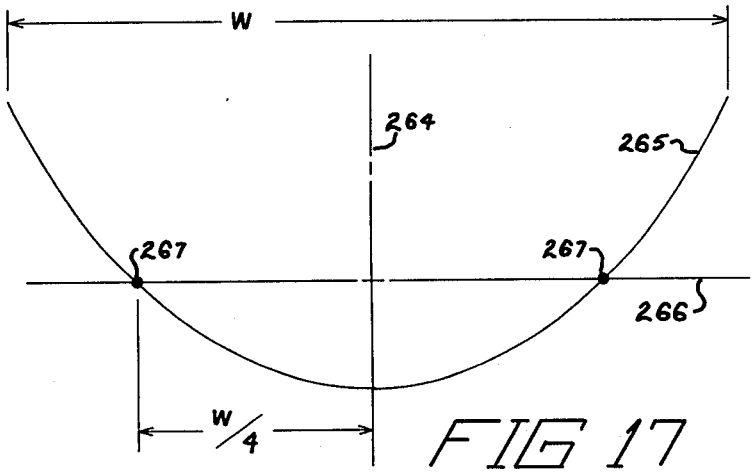
FIG. 17 is a diagrammatic showing of the line of curvature of the deflection of a parabolic rear squeegee during use to indicate a manner of locating the center axis of squeegee deflection.

For a parabolic squeegee assembly having bilateral symmetry relative the vertical longitudinal center plane, designated by line 264 in FIG. 17, that is parallel to the normal forward direction of travel on the machine on which it is mounted, the effective line of application of force from the squeegee (rear squeegee of the first and third embodiments) to the surface being cleaned is designated 265 in FIG. 17 while the transverse width thereof is designated W. The center axis of squeegee deflection 266 intersects the line 265 on either side of the center plane 264 of the squeegee at point 267, the transverse spacing of each point 267 from the center plane being W/4. With transversely spaced spring urged linkages such as described herein for mounting the rear squeegee assemblies, the linkages are spaced and connected to the respective squeegee frame such that the downward force applied thereto intersects the center axis of squeegee deflection substantially at its intersection with center plane 264, or substantially at equal distances from the center plane on eiter transverse side thereof.

With reference to, for example, parabolic squeegees, the "length" referred to in the preceding four paragraphs is the arcuate length thereof.

As to the first and second embodiments of the rear squeegee assembly, the downwardly directed force of the spring urged assemblies is preferably applied to the squeegee frame above and horizontally adjacent the center axis of squeegee deflection, i.e. pivots 94 preferably being substantially directly vertically above intersections 267 of FIG. 17. As to the third embodiment of the rear squeegee assembly, the linkages 236, 249 and 251 at each side extend at higher elevations than, and preferably are substantially longitudinally aligned with the respective intersection 267 of FIG. 17.

With reference to the side squeegee assemblies the rear squeegee assemblies of the first and second embodiments and the rear squeegee of the third embodiment there is provided quick release means for removably mounting the squeegees on the squeegee frames wherein hand tools are not ordinarily required for changing the squeegee and only a single lever has to be pivoted (turned) to release the clamping pressure; while with reference to the front squeegee of the third embodiment, only a single bolt has to be turned for releasing the clamping pressure on the front squeegee.

With the clamp mechanism of the invention, the rear and front squeegees of the rear squeegee assembly can be removed, and replaced in a relatively short period of time, for example, about five minutes. Similarly, the side squeegee can be replaced in a short period of time.

With the squeegees mounted in the manner described above, there is no sharp change in direction along the length of the squeegee. Where there is a relatively sharp change of direction, therealong the squeegee material hardens, and as a result a greater downward force has to be exerted to obtain reasonable wiping action along the hardened part of the squeegee. This results in faster wearing of the hardened part of the squeegee and such is avoided by the manner of mounting the squeegees as described herein.

What is claimed is:

1. For a surface maintenance machine, a squeegee assembly comprising an elongated flexible squeegee, an elongated squeegee frame having a first terminal end portion, a second terminal end portion and an elongated arcuately curved backing surface intermediate portion between said end portions, and operable quick release means for clamping the squeegee against the backing surface and retaining the squeegee in a squeegee working position on the frame and alternately for releasing the squeegee, said quick release means including an over center locking device that is operable between a squeegee clamping position and a squeegee release position, an elongated band having a first end portion, an intermediate portion and a second end portion, said band first end portion and squeegee frame first end portion having cooperating means for transmitting a force from the band to the squeegee frame to move the band intermediate portion toward the backing surface intermediate portion when the locking device is operated from its release position toward its clamping position, means for connecting the device to the band second end portion, and means for connecting the locking device to the squeegee frame second end portion, the last mentioned means including an elongated second band having a first end portion connected to the locking device, and a second end portion, said second band second end portion and squeegee frame second end portion having cooperating means for transmitting a force from the second band to the squeegee frame when the locking device is operated from its release position toward its clamping position, the locking device comprising means for forcing the bands to exert a force on their second end portions to move them away from one another when the locking means is moved from its release position toward its clamping position, and the cooperating means including squeegee frame portions to limit the movement of the band second end portions away from one another.

2. For a surface maintenance machine, a squeegee assembly comprising an elongated flexible squeegee, an elongated squeegee frame having an elongated backing surface, elongated clamp means operable between a first condition to cooperate with the squeegee frame for clampingly engaging the squeegee to hold the squeegee against the backing surface and alternately to a second condition for releasing the clamping engagement, the clamp means including elongated band means for engaging the squeegee opposite the backing surface, each of said band means, squeegee frame and squeegee having a first end portion and a second end portion, said squeegee frame and band means first end portions having cooperating means for supportingly retaining the band means first end portion on frame when the clamp means is in its clamping condition, said clamp means including operable means acting against the frame second end portion and the band means second end portion for moving the band means relative the backing surface to clamp the squeegee between the band means the the backing surface, including clamping the squeegee first end portion between the band means and squeegee frame first end portions, the means acting against the frame second end portion including an over center locking device, the backing surface along at least the squeegee frame first end portion being arcuately curved, the backing surface having an elongated intermediate portion that at the intersection with a horizontal plane extends in a straight line, said band means comprising an elongated band having said band means first and second end portion and an elongated intermediate portion between said band means first and second end portions, said band means in a clamp means clamping condition including a clamp member having an elongated, squeegee engaging surface portion for engaging the side of the squeegee opposite the backing surface intermediate portion and a plurality of spaced spacer members joined to the clamp member surface portion to extend outward therefrom in a direction away from the squeegee, said spacer members having vertical terminal edges remote from the clamp member surface portion that are located along a circle having a radius of curvature on the opposite side of the backing surface intermediate portion from the band intermediate portion.

3. The squeegee assembly, of claim 2 wherein it is a side squeegee assembly, that the first end portions comprise rear end portions, that the second end portions comprise front portions, and that said backing surface in a forward direction from a location forwardly of its first end portion is progressively inclined in a vertical direction to be at a larger angle relative to the vertical.

4. For a surface maintenance machine, a squeegee assembly comprising an elongated flexible squeegee, an enlongated squeegee frame having an elongated arcuately concavely curved backing surface, elongated clamp means operable between a first condition to cooperate with the squeegee frame for clampingly engaging the squeegee to hold the squeegee against the backing surface and alternately to a second condition for releasing the clamping engagement, the clamp means including elongated band means for engaging the squeegee opposite the backing surface, each of said band means, squeegee frame and squeegee having a first end portion and a second end portion, said squeegee frame and band means first end portions having cooperating means for supportingly retaining the band means first end portion on frame when the clamp means is in its clamping condition, said clamp means including operable means acting against the frame second end portion and the band means second end portion for moving the band means relative the backing surface to clamp the squeegee between the band means and the backing surface, including clamping the squeegee first end portion between the band means and squeegee frame first end portions, said cooperating means including a squeegee frame surface portion that extends away from said backing surface in a direction generally toward the squeegee frame second end portion and a band means hooked end portion to engage said surface portion between said surface portion and the backing surface.

5. The squeegee assembly of claim 4 further characterized in that the operable means includes adjustment bolt means acting between band means second end portion and the squeegee frame second end portion for selectively moving the band means to clamp the squeegee between the band means and the backing surface.

6. The squeegee assembly of claim 4 further characterized in that said band means comprise a band having said hooked portion, said band means second end portion and a main body portion between said hooked portion and said band means second end portion, said main body portion having an elongated convex surface for abutting against the squeegee, and that the last mentioned operable meas includes means for forcing the band second end portion toward said hooked portion to place the main body portion in compression.

7. The squeegee assembly of claim 6 further characterized in that said squeegee frame includes a top wall, a back wall dependingly joined to the top wall, a front wall dependingly joined to the top wall in spaced relationship to the back wall to, in conjunction with said top wall and back wall, form a vacuum channel portion, and an outlet opening to the vacuum channel portion for applying a vacuum thereto, said front wall having the above mentioned backing surface remote from said back wall and said back wall having an elongated convexly curved backing surface remote from the front wall, an elongated flexible second squeegee, elongated second band means for applying a clamping pressure to the second squeegee to hold it against the back wall backing surface, said second band means having a main body portion that has an elongated concavely curved surface portion for abutting against the second squeegee, a first end portion to hookingly engage the squeegee frame first end portion and joined to the second band means main body portion, and a second end portion, and means for acting against the squeegee frame second end portion and the second band means second end portion for placing second band means main body portion in tension to clamp the second squeegee between the second band means concavely curved surface portion and the back wall backing surface.

8. The squeegee assembly of claim 6 further characterized in that means for forcing the second band portion comprises adjustment bolt means for acting against the squeegee frame and the band first end portion for selectively placing the main body portion in compression.

9. A surface maintenance machine comprising a mobile vehicle having a normal forward direction of movement, a vehicle frame, a downwardly opening brush housing, means for mounting the housing on the vehicle frame, a power driven scrubbing tool rotatably mounted in the housing, a transversely elongated rear squeegee assembly extending rearwardly of the tool and having a first end portion, a central portion and a second end portion, parallel arm means connected to each of the rear squeegee assembly end portions and the housing to mount the assembly for vertical movement, while permitting one of the rear squeegee assembly end portions moving to a higher elevation than the other, means for selectively retaining the rear squeegee assembly in an elevated travel position and alternately lowering the rear squeegee assembly, and in the squeegee assembly lowered position, limit the downward movement of the central portion while permitting the central portion to move freely upwardly, first spring urged arm means connected to the housing, and to the squeegee assembly between its first end portion and the central portion for constantly exerting a downward force on the squeegee assembly, and second spring urged arm means connected to the housing and to the squeegee assembly between the second end portion and the central portion for constantly exerting a downward force on the squeegee assembly, a pair of longitudinally elongated side squeegee assemblies extending transversely inwardly of the rear squeegee assembly end portions and forwardly of the rear squeegee assembly, one on either transverse side of the tool, spring urged means for each side squeegee assembly mounted on the housing for mounting the respective side squeegee assembly for limited vertical movement relative the housing and constantly resiliently urging it downwardly relative the housing, the rear squeegee assembly spring urging means, and each of the side squeegee assembly mounting means comprising means for urging the respective assembly downwardly under nearly constant pressure within the limits of the vertical movement of the assembly relative to the housing, the last mentioned urging means including a first and a second arm that each have a first end portion and a second end portion, first means for pivotally connecting the first arm first end portion to the housing, second pivot means for pivotally connecting the second arm second end portion to the respective squeegee assembly, means for pivotally connecting the arms second end portions together at an elevation between the first and second pivot means, ans spring means acting through the second end portion connecting means and the arms for resiliently urging the second pivot means downwardly, each side squeegee assembly urging means including a third arm having one end pivotally connected to the housing and an opposite end pivotally connected to the respective side squeegee assembly, each squeegee assembly including an elongated squeege frame having a first end portion, a second portion and an elongated squeegee backing surface, an elongated squeegee, and elongated band means operable between a squeegee release position and a position clamping the squeegee against the squeegee backing surface, the band means including an elongated band having a hooked end portion for hookingly engaging th squeegee frame first end portion, and an opposite end portion, and operable means for acting against the band end portion and the squeegee frame second end portion for clamping the squeegee against the squeegee frame, and alternately release the clamping engagement.

10. A surface maintenance machine comprising a mobile vehicle having a normal forward direction of travel, a vehicle frame, a longitudinally elongated side squeegee assembly, and means for mounting the squeegee assembly on the frame, the squeegee assembly including a squeegee frame having a backing surface portion that has a longitudinally elongated convoluted backing surface, said backing surface having a rear portion extending substantially parallel to the vertical, a front portion extending transversely outwardly in a downward direction and predominantly vertically, and an elongated intermediate portion extending between the front and rear portion, an elongated squeegee, and means for retaining the squeegee on the squeegee frame in engagement with the backing surface and in depending relationship thereto, the squeegee frame backing surface portion having a rear section extending rearwardly of the convoluted portion, said rear section having a squeegee backing surface that is arcuately curved to extend rearwardly and transversely inwardly, the rear section having a rear end portion, the squeegee retaining means including elongated band means operable between a release position and a clamping position to clamp the squeegee against the backing surface, said band means in a clamping position having a first end portion connected to the squeegee frame forwardly of the squeegee and a second end portion connected to the rear section rear end portion, the band means in the clamp position including a longitudinally elongated flexible band section on the opposite side of the squeegee from convoluted backing surface, and a clamp member between the band section and squeegee that has a longitudinally elongated squeegee engaging surface that is concoluted, and longitudinally spaced band section engaging surfaces that in a rearward direction are progressively more transversely remote from the clamp member squeegee engaging surface and thence are progressively more closely adjacent the clamp member squeegee engaging surface.

11. The apparatus of claim 10 further characterized in that the clamp member has longitudinally spaced spacer members that extend rearwardly and transversely rearwardly of the clamp member squeegee engaging surface, each spacer member having a terminal band section engaging edge that provides one of the band section engaging surfaces.

12. The apparatus of claim 10 further characterized in tht the squeegee has a plurality of longitudinally spaced stud apertures extending transversely therethrough, that the clamp member has a plurality of longitudinally spaced stud apertures and that there are provided a plurality of longitudinally spaced studs mounted on the squeegee frame to extend transversely outwardly for extension through the squeegee apertures and into the clamp member apertures to support the squeegee and clamp member on the squeegee frame in the band means release position, and that one of the band means end portions has hooked end portion and that the squeegee frame has a band hooked end portion engaging surface portion to cooperate with the band meand hooked portion to retain it in clamping engagement with the squeegee frame when the band means is in the clamping position.

13. The apparatus of claim 10 further characterized in that the clamp member has a rear terminal end portion, that the arcuately curved backing surface extends rearwardly of the clamp member terminal end portion, and that the band means includes an elongated flexible band section for clampingly engaging the squeegee opposite the arcuately curved section.

14. The apparatus of claim 10 further characterized in that in a band means clamping position the clamp member squeegee engaging surface extends forwardly and transversely outwardly at an angle of about 3° to the normal direction of travel of the machine.

15. The apparatus of claim 10 further characterized in that the squeegee assembly has a front end portion and a rear end portion, that the squeegee assembly mounting means includes a longitudinally elongated squeegee frame mounting member and means mounting the squeegee frame on the mounting member for limited vertical movement between a datum position and positions the squeegee assembly front and rear end portion are at varying vertical elevations relative their positions in a datum position, the squeegee frame mounting means in a datum position including a first, a second and a third arm each having a first end portion and a second end portion, first pivot means for pivotally connecting the first arm first end portion to the squeegee frame mounting member, second pivot means for pivotally connecting the first arm second end portion to the squeegee frame at a lower elevation and rearwardly of the first pivot means, third pivot elevation and rearwardly of the first pivot means, third pivot means for pivotally connecting second arm first end portion to the squeegee frame mounting member, fourth means for pivotally connecting the third arm first end portion to the squeegee frame a substantial distance rearwardly of the second pivot means, and means for pivotally connecting the second and third arms together rearwardly of the third and fourth pivot means and vertical therebetween, resiliently urging the second and third arms second end portion forwardly, and limiting the forward movement of the second and third arm second end portions.

16. A surface maintenance machine comprising a mobile vehicle having a normal forward direction of movement, a vehicle frame, a downwardly opening brush housing, means for mounting the housing on the vehicle frame, a power driven scrubbing tool rotatably mounted in the housing, a transversely elongated rear sequeegee assembly extending rearwardly of the tool and having a first end portion, a central portion and a second end portion, parallel arm means connected to each of the rear squeegee assembly end portions and the housing to mount the assembly for vertical movement, while permitting one of the rear squeegee assembly end portions moving to a higher elevation than the other, means for selectively retaining the rear squeegee assembly in an elevated travel position and alternately lowering the rear squeegee assembly, and in the squeegee assembly lowered position, limit the downward movement of the central portion while permitting the central portion to move freely upwardly, first spring urged arm means connected to the housing, and to the squeegee assembly between its first end portion and the central for constantly exerting a downward force on the squeegee assembly, and second spring urged arm means connected to the housing and to the squeegee assembly between the second end portion and the central portion for constantly exerting a downward force on the squeegee assembly, each of the spring urged arm means including first, second, third and fourth arms that each have a first end portion and a second end portion, first pivot means for pivotally connecting the first and second arms first end portions and pivotally attaching said first and second arms first end portions to the housing, second pivot means for pivotally connecting the third and fourth arms first end portions together below the first pivot means and pivotally attaching the third and fourth arms first end portions to the squeegee assembly, third pivot means for pivotally connecting the first and third arms second end portions, fourth pivot means for pivotally connecting the second and fourth arms second end portions and means for resiliently urging the first and second arm second end portions toward the third and fourth arms second end portions, the last mentioned means being connected to the third and fourth pivot means.

17. The apparatus of claim 16 further characterized in that the pivot means have parallel pivot axes and that the third pivot means is on the opposite side of the plane of the first and second pivot axes from the fourth pivot axis.

18. For a surface maintenance machine, a squeegee assembly comprising an elongated flexible squeegee, an elongated squeegee frame having a first terminal end portion, a second terminal end portion remote from the first terminal end portion and an elongated backing surface intermediate portion having an elongated backing surface between said end portions, and quick release means mountable on the frame for clamping the squeegee against the backing surface and retaining the squeegee in a squeegee working position on the frame and alternately for releasing the squeegee, said quick release means including an over center locking device that is operable between a squeegee clamping position and a squeegee release position, an elongated band having a first end portion, an intermediate portion and a second end portion, said band first end portion and squeegee frame first end portion having cooperating means for transmitting a force from the band to the squeegee frame to move the band intermediate portion toward the backing surface intermediate portion when the locking device is operated from its release position toward its clamping position, means for connecting the device to the band second end portion, and means for connecting the locking device to the squeegee frame second end portion, said squeegee frame including an elongated backing surface portion having a surface forming at least part of the backing surface and an upper elongated linear edge, and the quick release means including a clamp member having an elongated squeegee engaging section having a squeegee engageable surface, a plurality of protrusions spaced along the length of the squeegee engaging section and extending outwardly from the squeegee engaging section on the side thereof opposite the squeegee engageable surface thereof, said protrusions having band engaging edges remote from the squeegee engaging section, said band engaging edges being located on the arc of a circle having a center of curvation on the opposition side of said squeegee engaging section from said band engaging edges.

19. A surface maintenance machine comprising a mobile vehicle having a vehicle frame, a squeegee assembly mounting member, means for mounting the mounting member on the vehicle frame, an elongated squeegee assembly having a squeegee frame, a squeegee, and means for securing the squeegee to the squeegee frame to extend to a lower elevation than the squeegee frame, and spring urged means connected between the squeegee assembly mounting member and the squeegee frame to permit limited vertical movement of the squeegee frame relative the squeegee assembly mounting member and constantly urge the squeegee frame downwardly under nearly constant pressure within the range of limited vertical movement, the above mentioned spring urged means including a mechanical arm having a first end portion and a second end portion, means having a generally horizontal first pivot axis for pivotally connecting the arm first end portion to the squeegee assembly mounting member, and spring urged means for connecting the arm second end portion to the squeegee assembly to resiliently urge the squeegee assembly to move downwardly, the second mentioned spring urged means including a second arm having a first end portion and a second end portion, means having a generally horizontal second pivot axis for pivotally connecting the first and second arms second end portions together, means having a generally horizontal third pivot axis parallel to the first pivot axis for connecting the second arm first end portion to the squeegee frame, and means connected to the second pivot axis means for resiliently urging the second pivot axis means in a direction to move the second pivot axis toward the plane of the first and third pivot axes, the last mentioned resilient urging means including a third arm, a fourth arm, each of the third and fourth arms having a first end portion and a second end portion, the third arm first end portion being pivotally mounted by the first pivot axis means, the fourth arm first end portion being pivotally mounted by the third pivot axis means, means having a generally horizontal fourth pivot axis parallel to the third pivot axis for pivotally connecting the third and fourth arm second end portions and means connected between the second and fourth pivot axis means for resiliently urging the second and fourth pivot axis means toward one another.

20. The apparatus of claim 19 further characterized in that the last mentioned resilient urging means includes a coil spring having a first end portion and a second end portion, means pivotally mounted on the second pivot axis means for mounting the spring first end portion in various selected adjusted positions at varying spacings from the second pivot axis.

21. A surface maintenance machine having a normal forward direction of motion comprising a mobile vehicle having a vehicle frame, a transversely elongated rear squeegee assembly that includes a squeegee that is generally parabolic in plan view, a squeegee assembly mounting member mounted on the vehicle frame, and means for mounting the squeegee assembly on the mounting member for limited vertical movement including first and second spring urged means connected to the squeegee assembly in transverse spaced relationship closely adjacent positions that are in longitudinal alignment with the intersections of the center axis of squeegee deflection with the squeegee and connected to the mounting member for maintaining the downward force exerted by the squeegee assembly on the surface being cleaned nearly constant even with limited vertical movement of the mounting member relative the surface, each of the above spring urged means including a first and a second elongated arm that each have a front end portion and a rear end portion, first pivot means having a generally horizontal pivot axis for pivotally connecting the first arm front end portion to the squeegee assembly, second pivot means having a generally horizontal pivot axis a substantial distance forwardly of the first pivot axis for pivotally connecting the second arm rear end portion to the squeegee assembly, third pivot means having a generally horizontal pivot axis a substantial distance forwardly of the second pivot axis for pivotally connecting the second arm front end portion to the mounting member, a crank arm having a first end portion and a mid portion, fourth pivot means having a pivot axis for pivotally connecting the crank arm mid portion to the mounting member, spring means connected to the mounting member and the crank arm for constantly urging the crank arm to pivot about the fourth pivot means pivot axis in a direction to move the crank arm first end portion downwardly, and fifth pivot means for pivotally connecting the first arm rear end position to the crank arm first end portion, the first and second arms of each of the first and second spring urged means extending in directions relative one another that the lines of downward directed force exerted by them intersect the surface being squeegeed closely adjacent the center axis of squeegee deflection closely adjacent the center axis of squeegee deflection when the squeegee assembly is in a normal position of use.

* * * * *

UNITED STATES PATENT AND TRADEMARK OFFICE

CERTIFICATE OF CORRECTION

PATENT NO. : 4,037,289

DATED : July 26, 1977

INVENTOR(S) : Harold D. Dojan

It is certified that error appears in the above-identified patent and that said Letters Patent are hereby corrected as shown below:

Column 1, line 18 "by" should be --weak--; Column 1, line 19 "buy" should be --by--; Column 3, line 48 "vieew" should be --view--; Column 5, line 9 "stubs" should be --studs--; Column 5, line 23 "Preferaly" should be --Preferably--; Column 5, line 62 "cuased" should be --caused--; Column 5, line 62 "aginst" should be --against--; Column 7, line 64 "therof" should be --thereof--; Column 8, line 25 "226" should be --266--; Column 8, line 57 "surfce" should be --surface--; Column 10, line 55 insert --.-- after housing; Column 11, line 8 "lightly" should be --slightly--; Column 11, line 24 "The downward downwardly. The" should be --The downward forces--; Column 11, line 32 "dows" should be --does--; Column 11, line 59 "angel" should be --angle--; Column 12, line 23 "terethrough" should be --therethrough--; Column 12, line 52 "vertical" should be --band--; Column 13, line 4, "aginst" should be --against--; Column 14, line 18 "engging" should be --engaging--; Column 14, line 30 "extned" should be --extend--; Column 14, line 54 delete "."; Column 14, line 65 "posibility" should be --possibility--; Column 15, line 15 ";" should be --,--; Column 15, line 30 "tor" should be --for--; Column 15, line 44 "transerse" should be --transverse--; Column 15, line 51 "rea" should be --rear--; Column 15, line 52 "inardly" should be --inwardly--; Column 16, line 31 "betweent" should be --between--; Column 16, line 48 "the" should be --The--; Column 16, line 54 "sqieegee" should be --squeegee--; Column 17, line 10 "veritical" should be --vertical--; Column 17, line 15 "238" should be --239--;

UNITED STATES PATENT AND TRADEMARK OFFICE

CERTIFICATE OF CORRECTION

PATENT NO. : 4,037,289
DATED : July 26, 1977
INVENTOR(S) : Harold D. Dojan

It is certified that error appears in the above-identified patent and that said Letters Patent are hereby corrected as shown below:

Column 17, line 42 "wit" should be --with--; Column 17, line 52 "281" should be --284--; Column 17, line 60 "assembliy" should be --assembly--; Column 17, line 68 insert --in-- after "(d"; Column 18, line 64 "eiter" should be --either--; Column 19, line 12 insert --,-- after "assemblies"; Column 20, line 28 "the" (third occurrence) should be --and--; Column 22, line 50 "ans" should be --and--; Column 23, line 15 "portion" should be --portions--; Column 23, line 50 "tht" should be --that--; Column 23, line 60 after "has" insert --a--; Column 23, line 62 "meand" should be --means--; Column 24, line 17 "portion" should be --portions--;

Column 24, line 46 "sequeegee" should be --squeegee--; Column 24, line 60 after "central" insert --portion--; Column 28, lines 8 and 9, delete "closely adjacent the center axis of squeegee deflection"; Column 24, line 27 delete "third pivot elevation and rearwardly of the first pivot means,".

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*